US012637855B2

(12) United States Patent
Marshall, III

(10) Patent No.: US 12,637,855 B2
(45) Date of Patent: May 26, 2026

(54) RODENT PROTECTION AND FLOOD RELEASE INSERT FOR A STRUCTURE OPENING

(71) Applicant: Your Crawl Space, Inc., Awendaw, SC (US)

(72) Inventor: Henry Bennie Marshall, III, McClellanville, SC (US)

(73) Assignee: YOUR CRAWL SPACE, INC., Awendaw, SC (US)

( * ) Notice: Subject to any disclaimer, the term of this patent is extended or adjusted under 35 U.S.C. 154(b) by 211 days.

(21) Appl. No.: 18/338,617

(22) Filed: Jun. 21, 2023

(65) Prior Publication Data

US 2023/0332399 A1 Oct. 19, 2023

Related U.S. Application Data

(63) Continuation-in-part of application No. 18/049,415, filed on Oct. 25, 2022, now Pat. No. 12,133,520.
(Continued)

(51) Int. Cl.
*E04B 1/72* (2006.01)

(52) U.S. Cl.
CPC ..... *E04B 1/72* (2013.01)

(58) Field of Classification Search
CPC .. E04B 1/72; E04B 1/80; E04C 2/292; A01M 29/30; A01M 29/34; F24F 13/082
(Continued)

(56) References Cited

U.S. PATENT DOCUMENTS 2,611,310 A * 9/1952 Cowan ..... E04C 1/42 52/302.1
3,740,934 A * 6/1973 Shuler ..... B01D 46/10 55/504
(Continued)

FOREIGN PATENT DOCUMENTS

GB 2257246 A 1/1993
JP 9217958 A 8/1997
(Continued)

OTHER PUBLICATIONS

Print out from URL https://crawlspacedepot.com/ventblockplus-each/ (Access date Oct. 25, 2021).
(Continued)

*Primary Examiner* — Paola Agudelo
(74) *Attorney, Agent, or Firm* — Kim and Lahey Law Firm, LLC; Seann P. Lahey

(57) ABSTRACT

A mounting bracket surrounding a flexible polymer foam sheet with a protective mesh sheet movably carried on a front side. A mounting flange extending around an exterior perimeter. A front retaining ridge disposed on an interior surface engaging the front side of the flexible polymer foam sheet. An upper retaining flange extending downward from a top portion of the interior surface. A first side retaining flange extending laterally from a first side portion of the interior surface. A second side retaining flange extending laterally from a second side portion of the interior surface opposite the first side portion. A lower retaining flange extending upward from a bottom portion of the interior surface opposite the top portion. A receiving area between the front retaining ridge and the upper, lower and side flanges engaging a rear side of the flexible polymer foam sheet compressed against the receiving area to be releasably carried.

19 Claims, 15 Drawing Sheets

Related U.S. Application Data

(60) Provisional application No. 63/273,603, filed on Oct. 29, 2021.

(58) Field of Classification Search
USPC ..... 52/309.6
See application file for complete search history.

(56) References Cited

U.S. PATENT DOCUMENTS

| | | | | |
|---|---|---|---|---|
| 4,026,082 | A * | 5/1977 | Crofoot | F24F 7/00 52/656.2 |
| 4,520,715 | A | 6/1985 | Coomes | |
| 4,631,077 | A | 12/1986 | Spicer | |
| 4,829,882 | A | 5/1989 | Jackson | |
| 4,964,438 | A | 10/1990 | Welty | |
| 5,092,520 | A | 3/1992 | Lestage | |
| 5,253,804 | A | 10/1993 | Sarazen et al. | |
| 5,383,816 | A | 1/1995 | Marcello | |
| 5,460,572 | A * | 10/1995 | Waltz | E04B 1/7076 52/302.1 |
| 5,482,507 | A | 1/1996 | Priest | |
| 5,496,213 | A * | 3/1996 | Miller | E04G 15/02 52/302.1 |
| 5,564,976 | A | 10/1996 | Muller et al. | |
| 5,704,172 | A | 1/1998 | Gougeon | |
| D411,874 | S | 7/1999 | Ko et al. | |
| 5,944,445 | A | 8/1999 | Montgomery | |
| 6,149,514 | A | 11/2000 | Maury | |
| 6,227,962 | B1 * | 5/2001 | Orendorff | F24F 13/28 454/289 |
| D446,317 | S | 8/2001 | Jackson et al. | |
| D448,489 | S | 9/2001 | Jackson et al. | |
| 6,468,054 | B1 | 10/2002 | Anthony et al. | |
| 7,022,011 | B1 | 4/2006 | Rickman | |
| 7,097,557 | B2 | 8/2006 | Kutschman | |
| 7,270,498 | B1 | 9/2007 | Albanese | |
| D580,043 | S | 11/2008 | Sykes | |
| D583,042 | S | 12/2008 | Jackson et al. | |
| D593,193 | S | 5/2009 | Jackson et al. | |
| 7,581,361 | B1 | 9/2009 | Murkland | |
| 7,600,944 | B1 | 10/2009 | Keating | |
| D607,098 | S | 12/2009 | Sykes | |
| 7,780,509 | B1 | 8/2010 | Hoaks | |
| 7,926,539 | B1 | 4/2011 | Hurst et al. | |
| D654,162 | S | 2/2012 | Sykes | |
| 8,499,497 | B1 | 8/2013 | Hugueley | |
| 8,511,938 | B1 | 8/2013 | Payne et al. | |
| 9,353,569 | B1 | 5/2016 | Anderson, Jr. et al. | |
| 9,376,803 | B1 | 6/2016 | Anderson, Jr. et al. | |
| 9,758,982 | B2 | 9/2017 | Anderson, Jr. et al. | |
| D856,505 | S | 8/2019 | Sykes | |
| D875,233 | S | 2/2020 | Sykes | |
| 10,584,510 | B2 | 3/2020 | Anderson, Jr. et al. | |
| 11,280,082 | B1 * | 3/2022 | Moore | B01D 46/0005 |
| 11,603,657 | B1 | 3/2023 | Tesh | |
| 2002/0021941 | A1 | 2/2002 | Montgomery et al. | |
| 2003/0082008 | A1 | 5/2003 | Sprengle, Sr. et al. | |
| 2005/0186900 | A1 | 8/2005 | Janseky | |
| 2008/0113606 | A1 | 5/2008 | Janesky | |
| 2008/0182503 | A1 | 7/2008 | Yurcak | |
| 2008/0236062 | A1 | 10/2008 | Bergaglio | |
| 2009/0148236 | A1 | 6/2009 | Achen | |
| 2009/0158675 | A1 | 6/2009 | Sourlis | |
| 2009/0191807 | A1 | 7/2009 | Wood | |
| 2009/0239462 | A1 | 9/2009 | Hendricks | |
| 2010/0086358 | A1 * | 4/2010 | Haryslak | E02D 31/02 405/87 |
| 2012/0174501 | A1 | 7/2012 | Malitsky et al. | |
| 2012/0260593 | A1 | 10/2012 | Gower, Sr. | |
| 2013/0125481 | A1 | 5/2013 | Marshall | |
| 2013/0279986 | A1 | 10/2013 | Payne et al. | |
| 2015/0300026 | A1 | 10/2015 | Eisenkrein | |
| 2016/0138267 | A1 | 5/2016 | Ettinger | |
| 2016/0298380 | A1 * | 10/2016 | Anderson, Jr. | E04B 1/7076 |
| 2016/0298381 | A1 | 10/2016 | Anderson, Jr. et al. | |
| 2019/0203461 | A1 * | 7/2019 | Anderson | E06B 5/10 |
| 2020/0060227 | A1 | 2/2020 | Bofill | |
| 2021/0017759 | A1 * | 1/2021 | Sykes | E04B 1/7076 |
| 2022/0195720 | A1 | 6/2022 | Marshall | |

FOREIGN PATENT DOCUMENTS

| | | | |
|---|---|---|---|
| JP | 2004156841 | A | 6/2004 |
| KR | 1020100079709 | A | 7/2010 |

OTHER PUBLICATIONS

Crawlspace Depot Seal Crawlspace Vents Without a Lot of Time and Mess (spec sheet, 2021).

* cited by examiner

RODENT PROTECTION AND FLOOD RELEASE INSERT FOR A STRUCTURE OPENING

BACKGROUND OF THE INVENTION

1) Field of the Invention

The present invention relates to inserts for use in structure opening such as a vent opening in a crawl space or basement, and more particularly, to a mounting bracket releasably carrying a flexible foam insert and protective mesh sheet that allow for water pressure in the event of a flood to completely separate the flexible foam insert and protective mesh sheet from the mounting bracket opening to provide a clear unobstructed path for flood water to pass through the structure opening. Also, the flexible foam insert and protective mesh sheet are secured in the mounting bracket without mechanical fasteners, forms an airtight seal to control airflow through the structure opening, is adaptable to provide a combination of sealing, insulation and ventilation as needed for a given space, and provides protection against rodent and insect intrusion and damage.

2) Description of Related Art

Crawl spaces and basements may often be equipped with various vent openings in the walls to allow for airflow to control moisture levels and temperatures. These vent openings need to be covered to prevent rodents, debris, and water from entering into the crawl space or basement, while also allowing for airflow when necessary, or to provide insulation and resist airflow. It is also common to install various types of wire mesh behind vent covers to further protect against rodent intrusion. Typically, the vent covers and wire mesh are mechanically fastened to the walls of the opening to secure them in place, which requires a significant amount of installation work. Originally installed vent covers are usually held in place with mortar, making replacement a major project. Over time, these vent covers, or wire mesh can break, corrode, or otherwise fail and require replacement at significant time and expense.

An issue with installing inserts, such as a vent cover, into structure openings involves imperfect openings resulting from excess mortar that interferes with fitment, construction variances in size and shape, human error, and various other unexpected situations such as sealing an opening that was the result of damage or other unintended gaps for which no insert was designed or intended to fill.

Typically, a vent cover is attached to a foundation wall using fasteners such as screws, mortar and other such permanent mounted options. This requires various tools to level and shim the cover unit, as well as to drill and insert the screws into concrete, mortar and brick. The vent covers are typically constructed of a rigid material that leaves gaps between the wall and vent covers that air can pass through, which adversely impacts performance and allows debris, water, bugs and even rodents to enter the crawl space. While such gaps can be filed with caulk and the like, the installation is more complex and less accommodating for imperfect openings. Existing vent covers are not designed to form airtight seals without extensive additional installation steps to seal the rodent protection insert to the crawl space or basement walls. Thus, as a result, when an original vent cover fails, the first option is to install wire mesh behind the vent cover with mechanical fasteners simply to prevent rodent intrusion, while leaving the original vent cover in place.

Vent covers are known in the art that can include insulation to assist with temperature control around the vent opening. However, these insulation materials are typically rigid and brittle types of polymer foams that are easily broken or crack and will not flex and conform to a space for mounting a cover unit in a vent opening. These insulation foams are intended purely as an insulation layer and not a mounting element of any type.

Some rodent protection inserts have tried to use a flexible foam sheet with wire mess on the outside surface. The wire mesh is attached using a spray on adhesive and as the foam sheet flexes during installation, the wire mesh easily separates from the foam sheet and becomes ineffective. These covers are intended only to seal a vent closed and do not provide any ventilation option.

Additionally, crawl space vent opening may include various types of inserts and screen covers that are mechanically or otherwise fixed in place. In the event of a flood, these inserts and covers become a significant problem in restricting the flow of water through the crawl space vent openings. Further, existing flood vents tend to include flaps that open and close to allow water passage, but the flaps partially obstruct the opening which reduces the overall rating and flow capacity of the flood vent.

Accordingly, it is an object of the present invention to provide a rodent protection and flood release insert for use in a structure opening such as a crawl space or basement vent opening that includes a mounting bracket releasably carrying a flexible polymer foam sheet with a mesh protective layer for mounting in a structure opening such that the flexible polymer foam sheet with a mesh protective layer separate from the mounting bracket opening when subject to water pressure during a flood to provide a completely unobstructed opening for flood waters to pass through thus providing the maximum opening for the highest possible flood vent certification.

It is a further object of the present invention to provide a rodent protection and flood release insert having a mounting bracket releasably carrying a flexible polymer foam sheet with a mesh protective layer wherein the flexible polymer foam sheet compresses against and pushes back against the mounting bracket to conform to the shape of the mounting bracket and form an airtight seal.

It is a further object of the present invention to provide a rodent protection and flood release insert having a mounting bracket releasably carrying a flexible polymer foam sheet with a mesh protective layer wherein the mesh protective layer is mechanically attached but movably carried on the polymer sheet to avoid complete separation and allow for adjustments when mounting in the structure opening.

It is a further object of the present invention to provide a rodent protection and flood release insert for a structure opening such as crawl space or basement vent opening that is adaptable to both seal and ventilate the associated space.

SUMMARY OF THE INVENTION

The above objectives are accomplished according to the present invention by providing a rodent protection and flood release insert for a structure opening comprising a mounting bracket surrounding a flexible polymer foam sheet, wherein the flexible polymer foam sheet includes at least one airflow port, and a protective mesh sheet movably carried on a front side covering at least the airflow port; a mounting flange disposed around an exterior perimeter of the mounting bracket for engaging a structure surface surrounding a structure opening; a front retaining ridge disposed on an interior surface of the mounting bracket engaging at least one of the protective mesh sheet and the front side of the flexible polymer foam sheet, wherein the interior surface extends transverse to the mounting flange and defines an opening through the mounting bracket; an upper retaining flange extending downward from a top portion of the interior surface and engaging a rear side of the flexible polymer foam sheet; a first side retaining flange extending laterally from a first side portion of the interior surface and engaging the rear side of the flexible polymer foam sheet; a second side retaining flange extending laterally from a second side portion of the interior surface opposite the first side portion and engaging the rear side of the flexible polymer foam sheet; a lower retaining flange extending upward from a bottom portion of the interior surface opposite the top portion and engaging the rear side of the flexible polymer foam sheet; a receiving area disposed on the interior surface between the front retaining ridge and the upper, lower and side flanges, wherein the flexible polymer foam sheet compresses against the receiving area in a friction fit arrangement to be releasably carried in the mounting bracket; and, wherein a predefined amount of water pressure applied against the flexible polymer foam sheet causes the flexible polymer foam sheet to bend and separate completely from the interior surface so that the opening through the mounting bracket is unobstructed, and the at least one protective mesh sheet is adjustable relative to the front side of the flexible polymer foam sheet to facilitate bending and release of the flexible polymer foam sheet from the mounting bracket.

In a further advantageous embodiment, the front retaining ridge extends continuously along the top portion, the bottom portion, the first side portion, and the second side portion of the interior surface.

In a further advantageous embodiment, a first retaining tab extends from the first side retaining flange and engages the rear side of the flexible polymer foam sheet.

In a further advantageous embodiment, a second retaining tab extends from the second side retaining flange and engages the rear side of the flexible polymer foam sheet.

In a further advantageous embodiment, the first and second retaining tabs are disposed generally adjacent the lower retaining flange on opposite sides of the bottom portion of the interior surface.

In a further advantageous embodiment, the first side retaining flange, the second side retaining flange, and the lower retaining flange extend less than the upper retaining flange and engage less of the flexible polymer foam sheet so that the flexible polymer foam sheet releases from the bottom, first side and second side portions of the interior surface before the top portion when the water pressure is applied.

In a further advantageous embodiment, the at least one airflow port is disposed closer to the top portion of the interior surface when carried in the mounting bracket.

In a further advantageous embodiment, a removable plug is disposed in the at least one airflow port for controlling airflow through the airflow port.

In a further advantageous embodiment, the protective mesh sheet comprises a coated metal wire mesh.

In a further advantageous embodiment, a tether is included having a first distal end portion connected to the mounting bracket and a second distal end portion connected to the flexible polymer foam sheet.

In a further advantageous embodiment, the flexible polymer foam sheet includes a front score line extending into the front side of the flexible polymer foam sheet, and a rear score line extending into the rear side of the flexible polymer foam sheet to facilitate bending for separating from the mounting bracket.

In a further advantageous embodiment, the flexible polymer foam sheet is selected from the group consisting of polyethylene, polypropylene, polystyrene, polyvinyl chloride (PVC), poly(methyl methacrylate) (PMMA), epoxy resin, phenolic resin, polyester, polyurethane, and combinations thereof.

In a further advantageous embodiment, the flexible polymer foam sheet comprises a polyethylene foam having a closed cell structure on a front surface and a rear surface, and an open cell structure around a perimeter surface.

In a further advantageous embodiment, at least one securing member is included having a first portion anchored in the foam sheet and a second portion engaging the protective mesh sheet, wherein the second portion loops over at least one wire of the protective mesh sheet such that the protective mesh sheet is movable in both horizontal and vertical directions.

The above objectives are further accomplished according to the present invention by providing a mounting bracket for a rodent protection and flood release insert, the mounting bracket comprising a mounting flange disposed around an exterior perimeter for engaging a structure surface surrounding an opening; a front retaining ridge disposed on an interior surface, wherein the interior surface extends transverse to the mounting flange and defines an opening through the mounting bracket; an upper retaining flange extending downward from a top portion of the interior surface; a first side retaining flange extending laterally from a first side portion of the interior surface; a second side retaining flange extending laterally from a second side portion of the interior surface opposite the first side portion; a lower retaining flange extending upward from a bottom portion of the interior surface opposite the top portion; and, a receiving area defined along the interior surface between the front retaining ridge and the upper, lower, and side flanges for receiving a flexible polymer foam sheet in a friction fit arrangement to be releasably carried in the mounting bracket.

In a further advantageous embodiment, the front retaining ridge extends continuously along the top portion, the bottom portion, the first side portion, and the second side portion of the interior surface; and wherein the upper retaining flange extends across the top portion from the first side retaining flange to the second side retaining flange, the first and second side retaining flanges each extend across the first and second side portions, respectively, from the upper retaining flange to the lower retaining flange, and the lower retaining flange extends across the bottom portion from the first side retaining flange to the second side retaining flange.

In a further advantageous embodiment, a first retaining tab extends from the first side retaining flange and engages the rear side of the flexible polymer foam sheet, and a second retaining tab extends from the second side retaining flange and engages the rear side of the flexible polymer foam sheet, wherein the first and second retaining tabs are disposed generally adjacent the lower retaining flange on opposite sides of the bottom portion of the interior surface.

In a further advantageous embodiment, the first side retaining flange, the second side retaining flange, and the lower retaining flange extend less than the upper retaining flange and engage less of the flexible polymer foam sheet so that the flexible polymer foam sheet releases from the bottom, first side and second side portions of the interior surface before the top portion when the water pressure is applied.

The above objectives are further accomplished according to the present invention by providing a rodent protection and flood release insert for a structure opening comprising a mounting bracket surrounding a flexible polymer foam sheet, wherein the flexible polymer foam sheet includes a protective mesh sheet movably carried on a front side; a mounting flange disposed around an exterior perimeter of the mounting bracket for engaging a structure surface surrounding a structure opening; a front retaining ridge disposed on an interior surface of the mounting bracket engaging at least one of the protective mesh sheet and the front side of the flexible polymer foam sheet, wherein the interior surface extends transverse to the mounting flange and defines an opening through the mounting bracket; an upper retaining flange extending downward from a top portion of the interior surface and engaging a rear side of the flexible polymer foam sheet; a first side retaining flange extending laterally from a first side portion of the interior surface and engaging the rear side of the flexible polymer foam sheet; a second side retaining flange extending laterally from a second side portion of the interior surface opposite the first side portion and engaging the rear side of the flexible polymer foam sheet; a lower retaining flange extending upward from a bottom portion of the interior surface opposite the top portion and engaging the rear side of the flexible polymer foam sheet; wherein the upper retaining flange extends across the top portion from the first side retaining flange to the second side retaining flange, the first and second side retaining flanges each extend across the first and second side portions, respectively, from the upper retaining flange to the lower retaining flange, and the lower retaining flange extends across the bottom portion from the first side retaining flange to the second side retaining flange; wherein the front retaining ridge extends continuously along the top portion, the bottom portion, the first side portion, and the second side portion of the interior surface; a receiving area disposed on the interior surface between the front retaining ridge and the upper, lower and side flanges, wherein the flexible polymer foam sheet compresses against the receiving area in a friction fit arrangement to be releasably carried in the mounting bracket; wherein a predefined amount of water pressure applied against the flexible polymer foam sheet causes the flexible polymer foam sheet to bend and separate completely from the interior surface so that the opening through the mounting bracket is unobstructed, and the at least one protective mesh sheet is adjustable relative to the front side of the flexible polymer foam sheet to facilitate bending and release of the flexible polymer foam sheet from the mounting bracket; and, wherein the first side retaining flange, the second side retaining flange, and the lower retaining flange extend less than the upper retaining flange and engage less of the flexible polymer foam sheet so that the flexible polymer foam sheet releases from the bottom, first side and second side portions of the interior surface before the top portion when the water pressure is applied.

In a further advantageous embodiment, a first retaining tab extends from the first side retaining flange and engages the rear side of the flexible polymer foam sheet, and a second retaining tab extends from the second side retaining flange and engages the rear side of the flexible polymer foam sheet, wherein the first and second retaining tabs are disposed generally adjacent the lower retaining flange on opposite sides of the bottom portion of the interior surface.

BRIEF DESCRIPTION OF THE DRAWINGS

The system designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
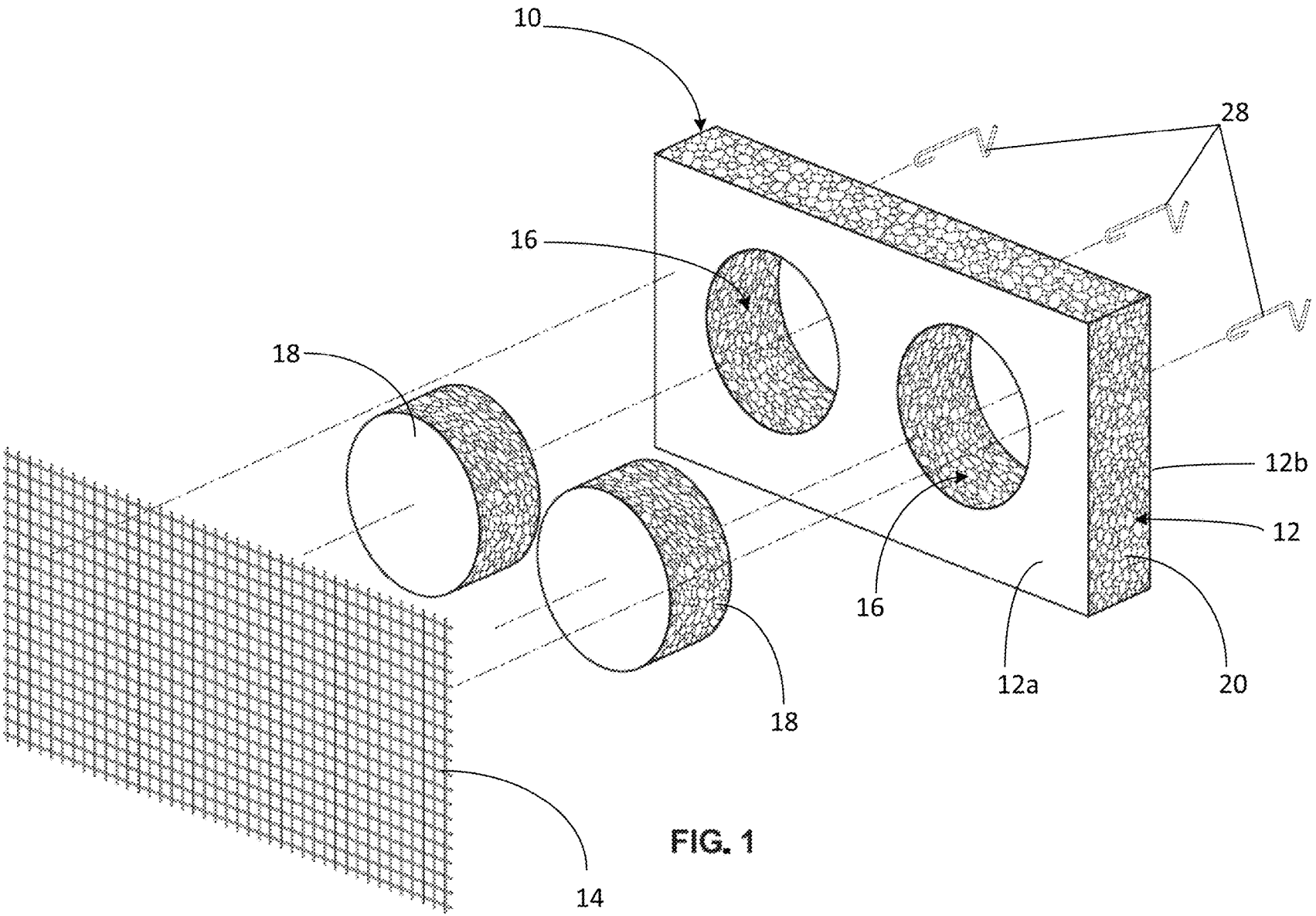
FIG. 1 shows an exploded front perspective view of a rodent protection insert according to the present invention.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

As shown in FIGS. 1-10, example embodiments are shown of a rodent protection insert, designated generally as 10, for use in a structure opening such as a vent opening in a crawl space or basement. The rodent protection insert 10 conforms to the structure opening walls to hold the rodent protection insert in place and form an airtight seal to control airflow through the structure opening without the need for mechanical fasteners. As shown and described herein, the rodent protection insert 10 is adaptable to provide a combination of sealing, insulation and ventilation as needed for a given space. Further, the rodent protection insert 10 includes protection against rodent intrusion and damage, and even insect intrusion. The insert can be used in basically any opening in the structure and is not limited to use in vent openings. Rather, it can be used to seal and control airflow and prevent rodent intrusion in attics, basements, crawl spaces, walls, ceilings, floors, doors, windows, roofs, and anywhere else an opening in the structure needs to be filled to control airflow and prevent rodent and insect intrusion. The rodent protection insert 10 of the present invention can be installed without the need to remove any existing vent covers or wire mesh that may have previously been installed, saving significant time and money while providing all the requirements for insulation, ventilation and rodent protection. Additionally, the rodent protection insert 10 is operable as a flood vent for structure openings in crawl spaces and basements. Because the rodent protection insert 10 does not use any mechanical fasteners to hold it in place, when water pressure in a flood situation reaches a certain point, the rodent protection insert 10 simply pops out of place and allows water to flow through the vent opening in the structure foundation.

Figure 2:
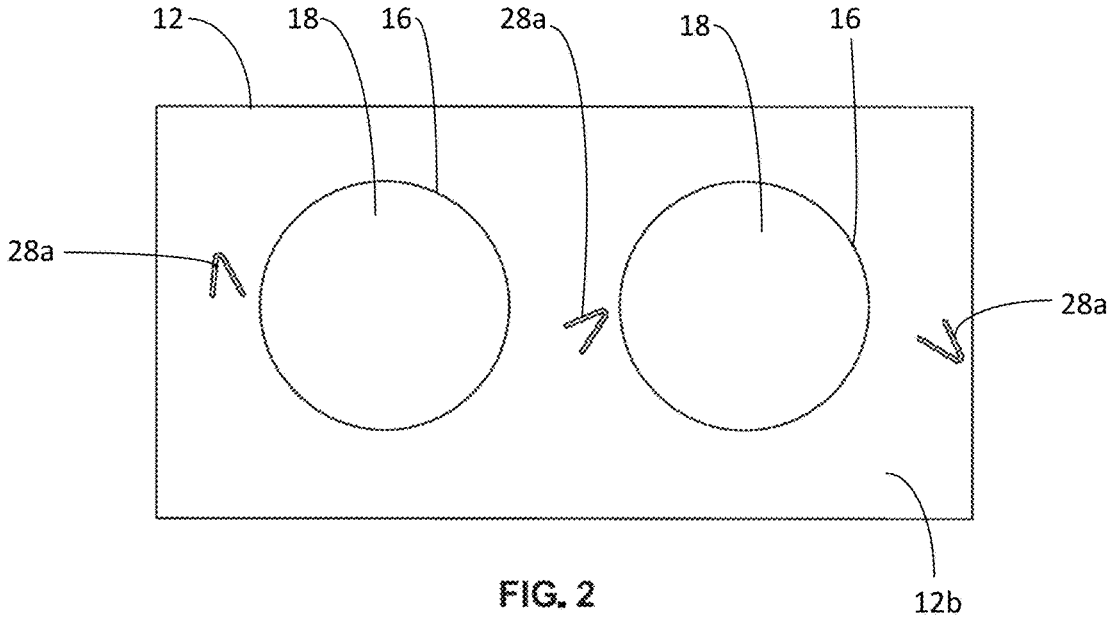
FIG. 2 shows a rear view of the rodent protection insert with the removable plugs installed in the airflow port according to the present invention.
Figure 3:
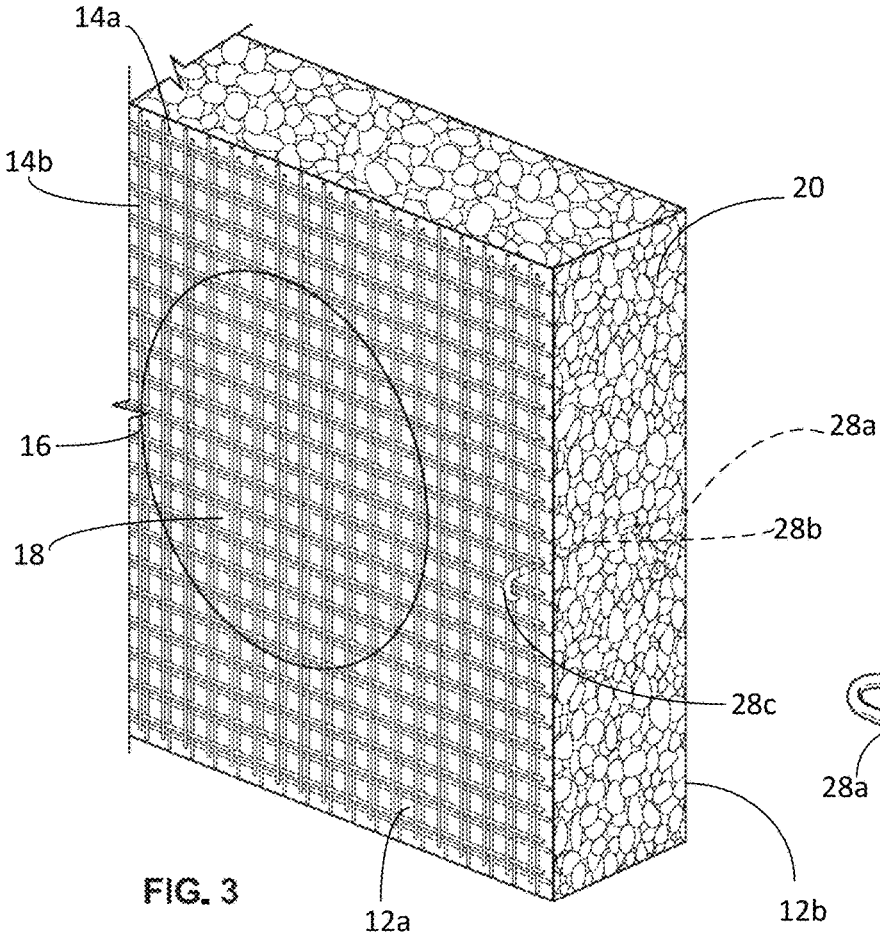
FIG. 3 shows a detailed front view of a portion of the rodent protection insert according to the present invention.
Figure 4:
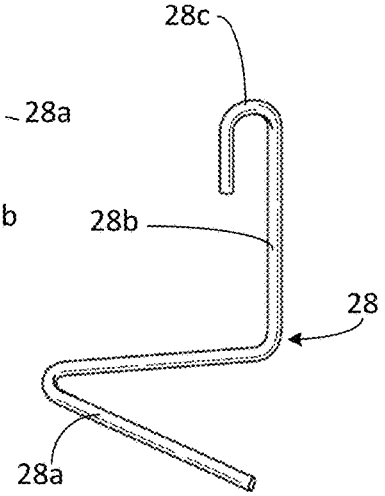
FIG. 4 shows a perspective view of a securing member of the rodent protection insert according to the present invention.
Figure 10:
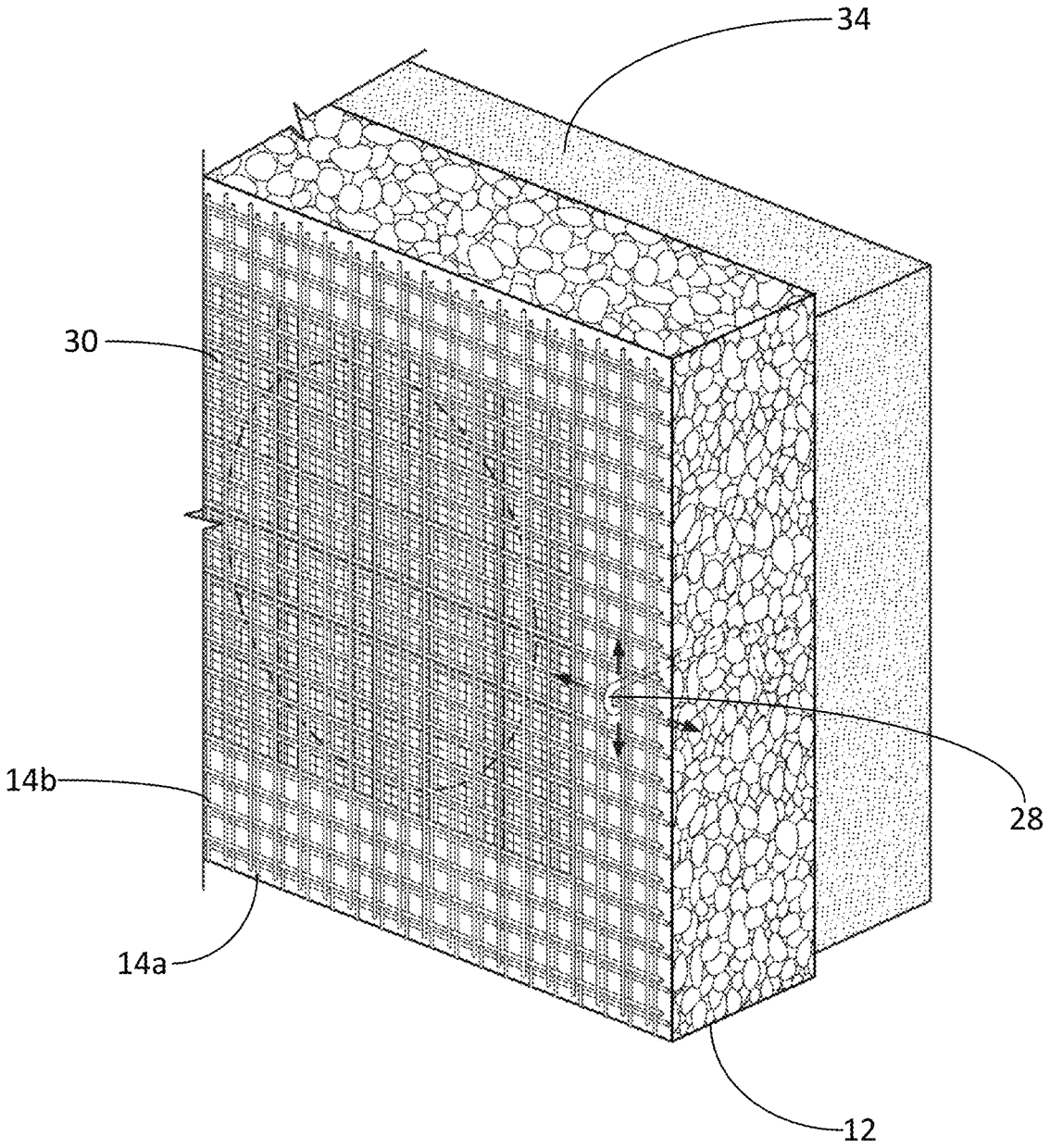
FIG. 10 shows a front perspective view of the rodent protection insert including an insulation block carried on a rear side according to the present invention.

Referring to FIGS. 1 and 2, in an illustrated embodiment, rodent protection insert 10 includes a flexible polymer foam sheet 12 with at least one protective mesh sheet 14 carried on a front side 12*a* of the flexible polymer foam sheet 12. In the preferred embodiment, at least one airflow port 16 is disposed in the flexible polymer foam sheet 12 with a removable plug 18 disposed in the airflow opening 16 for controlling airflow through the airflow port 16. The protective mesh sheet(s) are movably carried on front side 12*a* of flexible polymer foam sheet 12 to allow for adjustment during installation in a structure opening when engage the walls of the structure opening together with the flexible polymer foam sheet to hold the rodent protection insert 10 in position. To secure the protective mesh sheet(s) 14 to the flexible polymer foam sheet 12, at least one securing member 28 is provided having a first portion anchored in the foam sheet 12 and a second portion engaging at least one protective mesh sheet. The second portion loops over at least one wire of the at least one protective mesh sheet 14 such that the at least one protective mesh sheet 14 is movable in both horizontal and vertical directions (FIG. 10). Accordingly, the at least one protective mesh sheet 14 is mechanically connected to and adjustable relative to the front side 12*a* of flexible polymer foam sheet 12.

Figure 7:
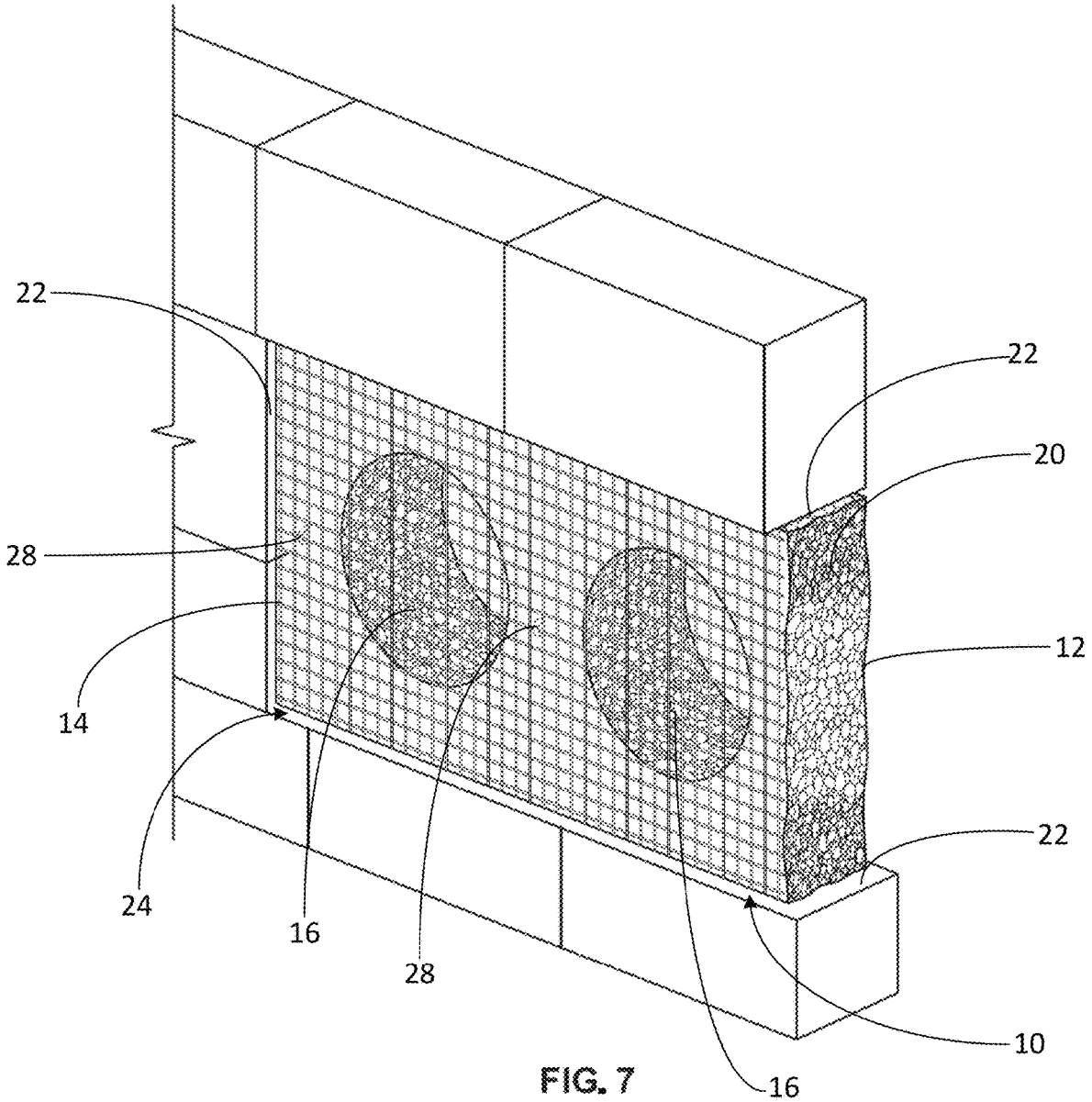
FIG. 7 show a front perspective cut-away view of the rodent protection insert mounted in a structure opening according to the present invention.

Referring to FIG. 7, a perimeter edge surface 20 of the flexible polymer foam sheet 12 compresses against and conforms to interior wall surfaces 22 within a structure opening, designated generally as 24. Accordingly, when mounted or otherwise installed in a structure opening 24, which in the illustrated embodiment is a crawl space vent opening, flexible polymer foam sheet 12 forms an airtight seal against the interior wall surfaces 22 and firmly hold the foam sheet 12 in place with a friction fit arrangement. The flexible polymer foam sheet 12 compresses against and pushes back against the interior wall surfaces 22 in a friction fit arrangement to be releasably carried in the vent opening. The flexible polymer foam sheet 12 preferably has a high resilience quick response compression and flexibility that presses firmly against the interior wall surfaces 22 to conform to the adjacent surface while providing a pressure against the surface to help hold the flexible polymer foam sheet 12 in position without mechanical fasteners. In a preferred embodiment, flexible polymer foam sheet 12 comprises a polyethylene foam sheet. Polyethylene foam is flexible, trimmable to custom fit to any non-standard size opening, waterproof, and UV resistant. Other flexible types of polymer foam sheets are also contemplated within the scope of the present invention so long as they are able to conform to and form an airtight seal against the walls of the structure opening. Suitable materials for the flexible polymer foam sheet can include polypropylene, polystyrene, polyvinyl chloride (PVC), poly(methyl methacrylate) (PMMA), epoxy resin, phenolic resin, polyester, polyurethane, and combinations thereof, so long as the material is constructed and arranged to be flexible, compressible and conforming in nature. In a preferred embodiment, the flexible polymer foam sheet 12 comprises a high resilience quick response polyethylene foam.

As noted above, an issue with installing inserts into common structure openings involves various imperfections in the structure openings, for example, excess mortar that interferes with fitment, construction variances in size and shape, human error, or even sealing an opening that was the result of damage or other unintended gaps for which no other insert was designed or intended to fill. The flexible polymer foam sheet 12 allows for mounting in rough and irregular shaped openings by compressing and conforming to imperfections in the interior wall surfaces 22 of the structure opening 24 to form an airtight seal against the walls defining the structure opening 24. Thus, no screws or drilling are needed to mount the rodent protection insert of the present invention in the structure opening 24. The flexible polymer foam sheet 12 has sufficient friction engagement to hold the rodent protection insert 10 in place in the structure opening 24. Thus, foam sheet 12 is squeezed into and seals against the interior surface of the structure. Accordingly, foam sheet 12 provides many benefits including an insulation layer that forms an airtight mounting within the structure opening, installs easily without the need to drill holes for screws or other types of mechanical fasteners, is waterproof, UV resistant, can easily be trimmed for odd sizes, and does not crack or break like other rigid insulation foams. This design helps contractors reduce labor installation time.

Additionally, the at least one protective mesh sheet 14 is smaller than front side 12*a* of flexible polymer foam sheet 12. The protective mesh sheet 14 thus engages interior wall surfaces 22 when perimeter surface 20 of flexible polymer foam sheet 12 is compressed in the structure opening 24 so that the protective mesh sheet 14 stabilizes and supports flexible polymer foam sheet 12 within structure opening 24. Further, the protective mesh sheets 14 can be folded over the foam sheet 12 to further conform to a given space. The foam sheet 12 will seal around the folded over mesh sheet 14 and still form an airtight seal against the wall surface 22 of the structure opening 24. Also, the protective mesh sheet 14 can be trimmed to confirm to a given structure opening.

In one arrangement, an adhesive or other sealing or bonding material can be applied to perimeter surface 20 around the perimeter of foam sheet 12 for further sealing and bonding of the flexible polymer foam sheet 12 to the interior wall surfaces 22 of structure opening 24. To apply the adhesive, the flexible polymer foam sheet 12 is first installed in the structure opening, and then a nozzle from the adhesive dispenser is inserted between the foam sheet 12 and wall surfaces 22 and moved around perimeter edge 20 to apply the adhesive or other sealant. The perimeter edge 20 deforms as the nozzle is inserted and moved across a given area. The perimeter edge 20 of foam sheet 12 then recompress against the interior wall surfaces 22 after the adhesive is applied and the nozzle removed. The adhesive preferably maintains at least 25% flexibility to allow for expansion and contraction. However, the use of adhesive is optional for a more permanent installation, but not required to hold the rodent protection insert 10 in position.

Figure 5:
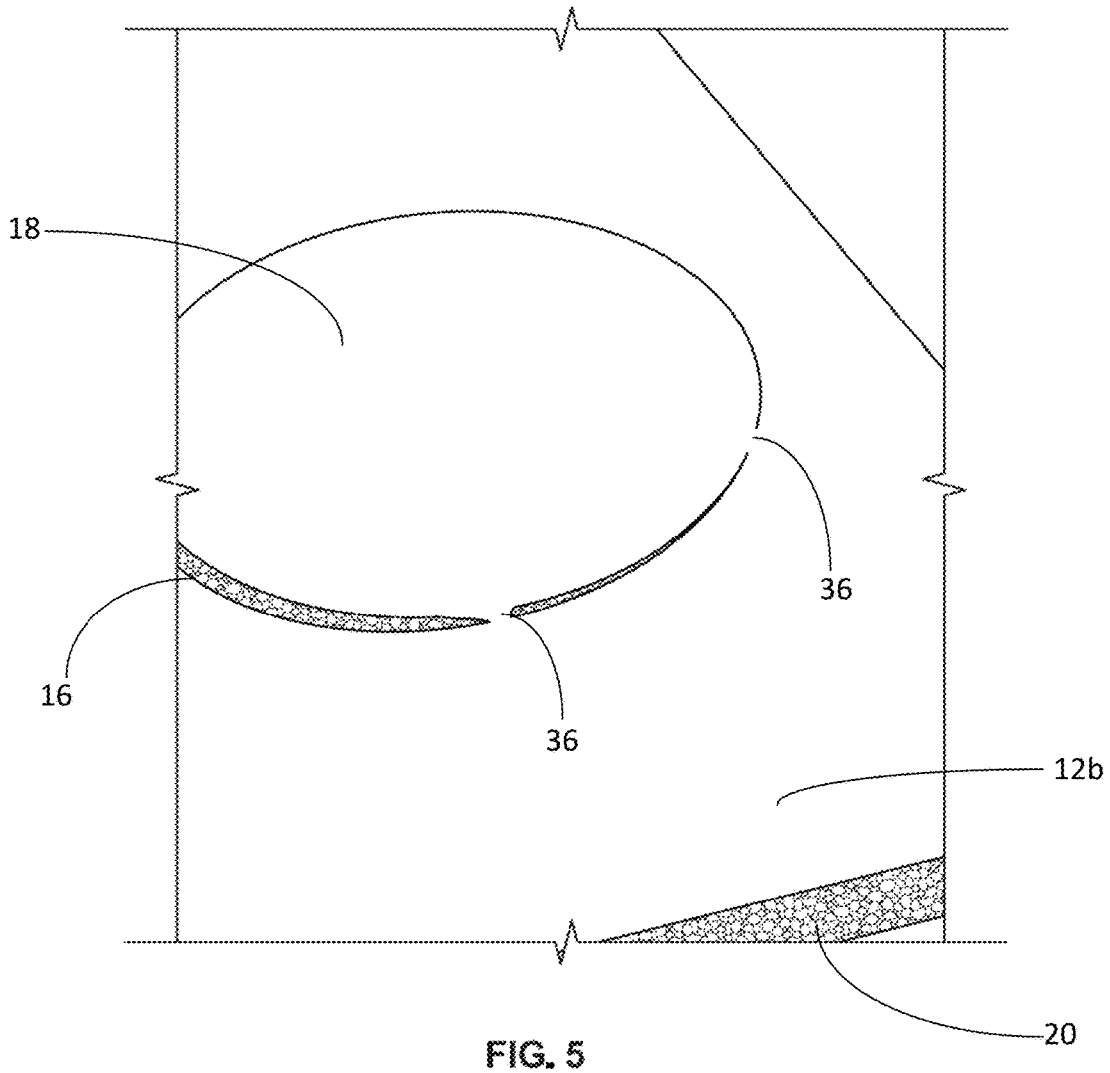
FIG. 5 shows a rear perspective view of the removable plugs and a connecting member according to the present invention.
Figure 6:
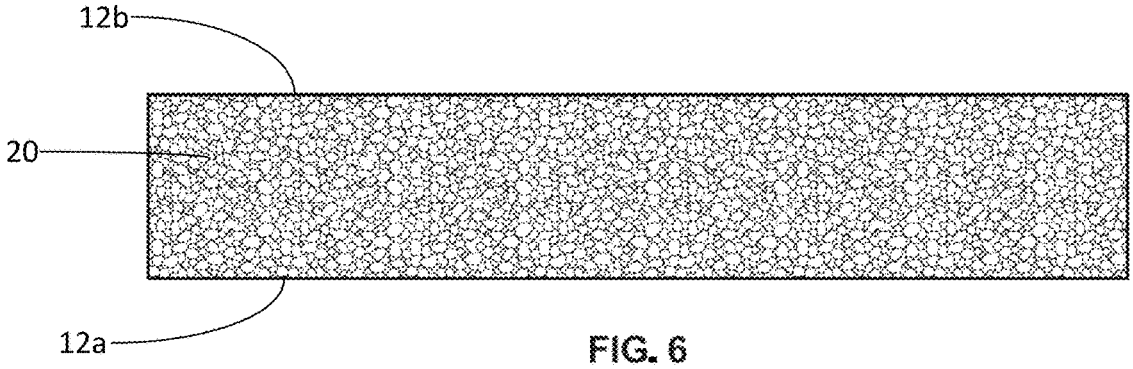
FIG. 6 shows a side view of a perimeter edge of the flexible polymer foam sheet having exposed open cells according to the present invention.

In a preferred embodiment, flexible polymer foam sheet 12 is a polyethylene foam having a closed cell structure on the front surface 12*a* (see FIG. 1) and the rear surface 12*b* (see FIGS. 2 and 5), and an exposed open cell structure around perimeter edge 20 (see FIGS. 1 and 6). This allows the adhesive to penetrate deeper into the perimeter surface 20 for sealing and bonding foam sheet 12 to the walls 22 of the structure opening 24, as shown in FIG. 7. Accordingly, flexible foam sheet 12 forms a tight seal to prevent air from leaking around the sides of the rodent protection insert 10 to prevent unwanted airflow leaking into or out of the associated structure opening. The closed cell structure being provided by a skin or non-porous layer covering the front and rear surfaces 12*a*, 12*b* of the sheet 12 such that the pores are sealed, while the perimeter edges have exposed cell pores from cutting the edges to expose the interior of the foam and open spaced within and between cells of the foam comprising the flexible foam sheet 12.

The protective mesh sheet 14 flexes with the flexible polymer foam sheet 12 as needed during installation without detaching from the flexible polymer foam sheet 12 when mounting in the structure opening 24 to facilitate conforming and sealing the flexible polymer foam sheet 12 within the structure opening 24. In a preferred embodiment, flexible polymer foam sheet 12 is slightly bigger than protective mesh sheet 12 so that when foams sheet 12 is compressed against interior wall surfaces 22, it allows the mesh sheet 14 to locate adjacent the interior wall surfaces 22 without interfering in the engagement and compression of foam sheet 12 in structure opening 24.

Referring to FIGS. 1-4, to prevent separation of the protective mesh sheet 14 from foam sheet 12 when flexing, at least one securing member 28 is used. In the illustrated embodiment, a series of securing members 28 are inserted into the rear surface 12*b* of flexible polymer foam sheet 12 and extend through and outward from front surface 12*a*. Securing members 28 engage with the protective mesh sheet 14 in a movable arrangement to provide a mechanical connection between the mesh sheet 14 and foam sheet 12 to prevent separation. In the illustrated embodiment, securing member 28 includes a first portion and a second portion. As best shown in FIG. 2, the first portion includes a generally V-shaped end section 28*a* that extends parallel along a rear surface 12*b* of flexible polymer foam sheet 12 when mounted in foam sheet 12. The first portion also includes a shaft 28*b* extending through flexible polymer foam sheet 12 to a front surface 12*a*. The second portion of securing member 28 includes a hook 28*c* looping over at least one wire of the at least one protective mesh sheet 14. As shown in FIG. 10, the strands of the protective mesh sheets 14*a* and 14*b* are arranged within hook 28*c* to be movable in both horizontal and vertical directions to provide adjust during installation in a structure opening which maintaining a mechanical connection to form sheet 12.

In the illustrated embodiment, securing members 28 are attached between airflow ports 16 and perimeter edge 20, and between both of airflow ports 16 along a straight line across the center of foam sheet 12. The securing members 28 eliminates any wrinkles and separation of protective mesh sheet 14 and foam sheet 12 when flexing during installation. The protective mesh sheet 14 when secured to foam sheet 12 helps to stabilize the rodent protection insert 10 in the structure opening 24 against wind or animal dislodging without the specific need for additional seals or mechanical securing members. While additional sealant or adhesive can be included around perimeter surface 20 for a more permanent installation as noted above, it is not required. The protective mesh sheet 14 flexes with the flexible polymer foam sheet 12 without detaching from the flexible polymer foam sheet when mounting in the structure opening 24 to facilitate conforming and sealing the flexible polymer foam sheet 12 within the structure opening 24.

Figure 8:
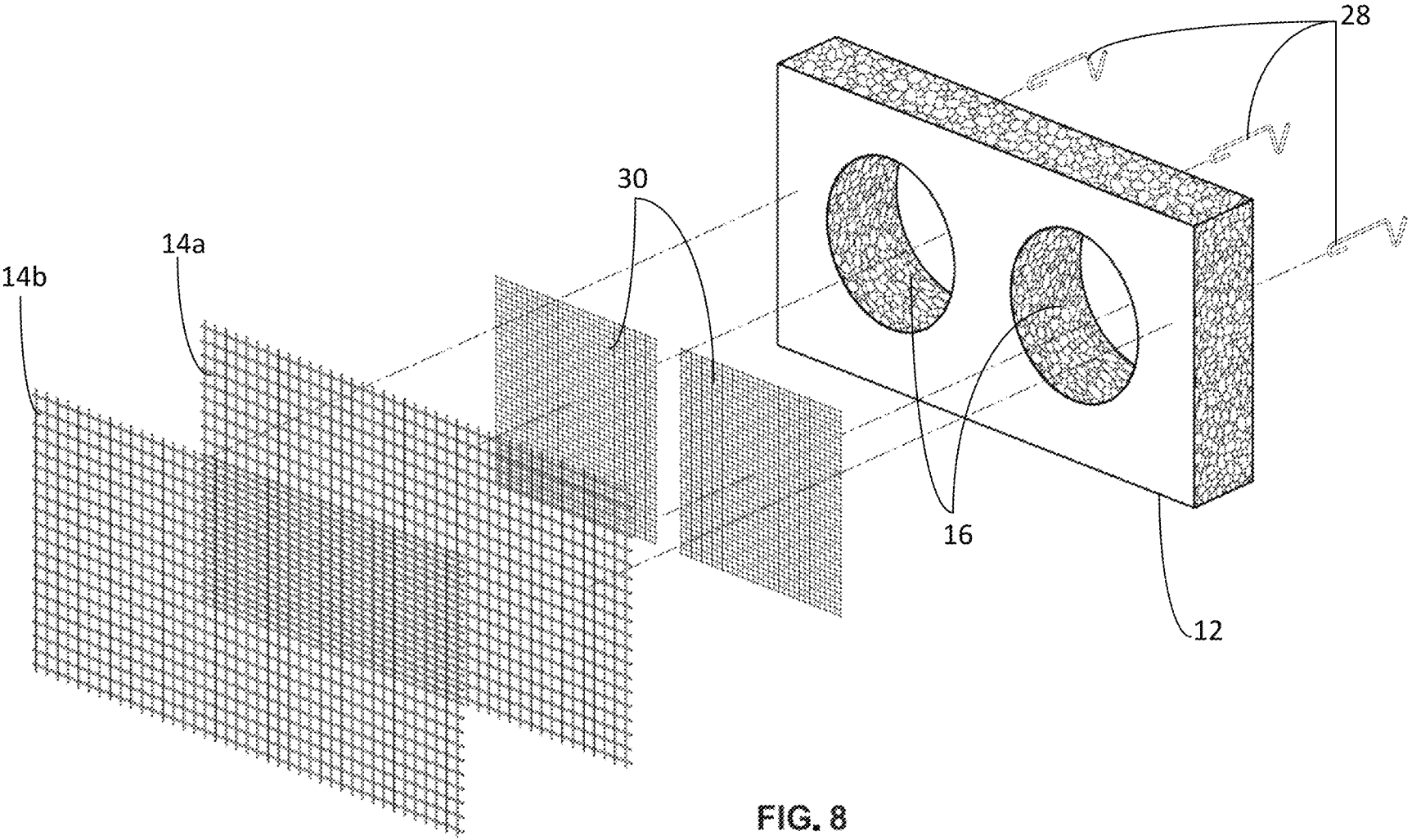
FIG. 8 shows an exploded front perspective view with multiple mesh sheets and an insect screen disposed over the airflow ports of the rodent protection insert according to the present invention.
Figure 9:
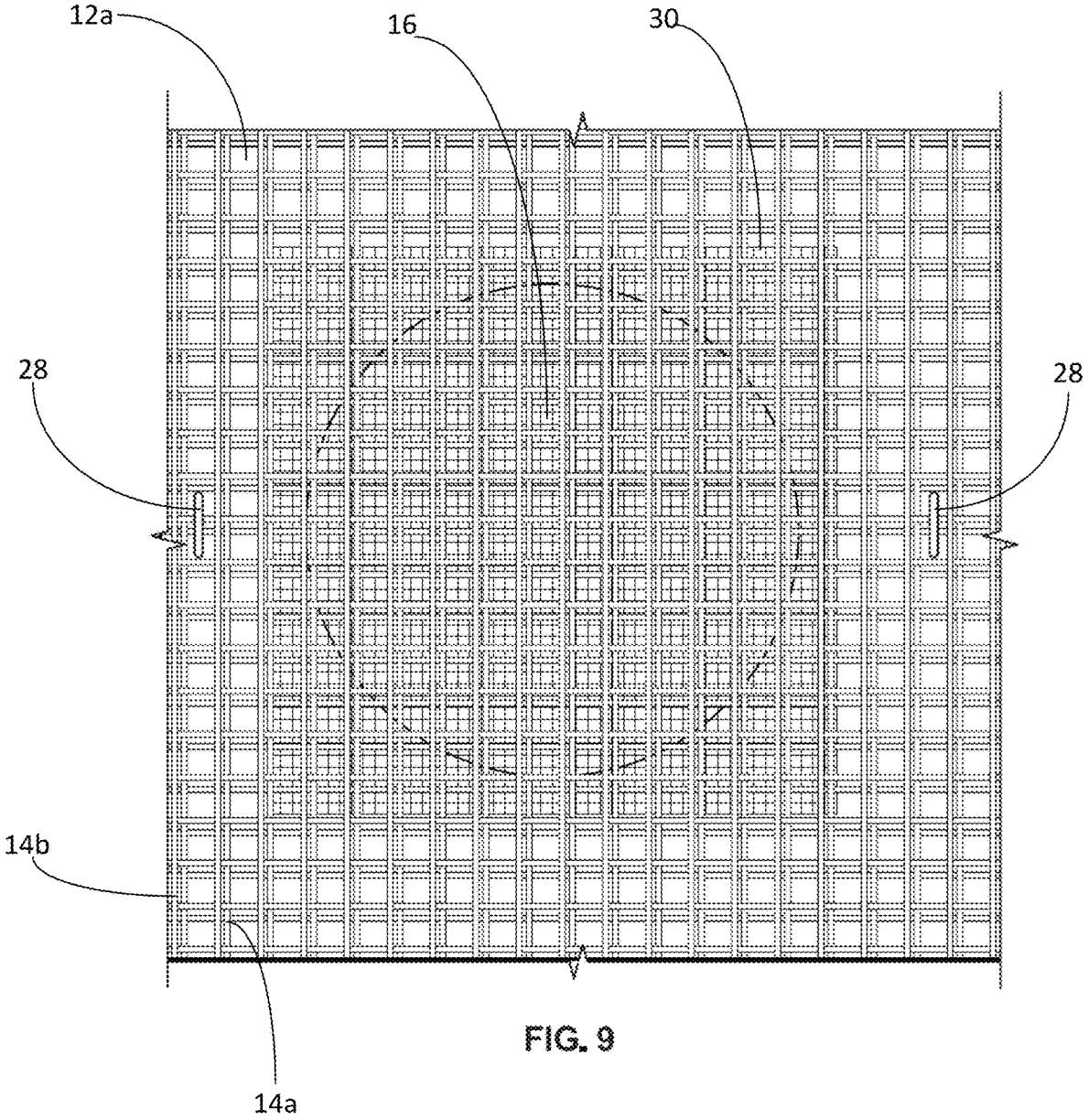
FIG. 9 shows a detailed front view of a portion of the rodent protection insert according to the present invention.

Referring to FIGS. 3, 8, 9 and 10, the use of securing members 28 allows for the stacking and securing of multiple layers of protective mesh sheet 14, particularly for commercial applications where additional rodent protection is needed. In the illustrated embodiments, a first protective mesh sheet layer 14*a* is secured to front surface 12*a* of foam sheet 12. A second protective mesh sheet layer 14*b* is then disposed on top of first protective mesh sheet layer 14*a*. The additional layer of mesh sheet 14*b* could be a larger mesh than first mesh sheet 14*a*. If the same size mesh is used for both sheets, it is desirable to off-set the mesh sheets 14*a* and 14*b* so that mesh does not line up, as best shown in FIG. 9. This arrangement further frustrates rodents that may attempt to chew threw the mesh. The mesh sheets 14*a* and 14*b* preferably comprise metal, or other durable rodent resistant mesh material. In one embodiment, protective mesh sheets 14*a* and 14*b* are preferably comprised of stainless steel. Mesh sheets 14*a* and 14*b* may also have a different thickness gauge such that mesh sheet 14*b* has a thicker gauge mesh sheet than mesh sheet 14*a*.

Referring to FIG. 8, in one embodiment, the rodent protection insert 10 includes an insect screen 30 carried on front side 12*a* of flexible polymer foam sheet 12 covering over the airflow port 16. Insect screen 30 is disposed between the protective mesh sheet 14 and the flexible polymer foam sheet 12. Insect screen 30 is intended to deter smaller critters, insects, and debris. This removable fine mesh insect screen 30, slides in from a top edge between the foam sheet 12 and mesh sheet 14. Insect screen 30 can be removed to meet airflow code requirements as needed since the finer mesh screen can restrict airflow. Optionally, when using insect screen 30, airflow openings 16 may be increased or made larger to compensate for restricted airflow. Insect screen 30 can be made of any suitable material such as fiberglass, metal wire, plastic etc.

Referring to FIG. 2, in the illustrated embodiment, the V-shaped end section 28*a* of the first portion of securing members 28 also function as a guide prong to assist with positioning rodent protection insert 10 in structure opening 24. A user's finger can be inserted under the V-shaped end section 28*a* to grab for manipulating the position of foam sheet 12 in a structure opening 24. Thus, in addition to resisting securing member 28 for pulling through foam sheet 12, V-shaped end section 28*a* provide a grab point to help control and hold rodent protection insert 10 while adjusting and fine tuning the position in structure opening 24.

Referring to FIG. 1, airflow port 16 comprises a 5¼" opening formed in foam sheet 12. Smaller structure openings may require a rodent protection insert 10 with only one airflow port 16 while larger structure openings may require a rodent protection insert 10 with multiple airflow ports 16 that may be of various sizes. For example, a standard structure opening 24 such a vent in a crawl space is intended to be 8"×16" but every crawl space and basement vent opening can be different. The typical 8"×16" will require two 5¼" opening with removable plugs 18, as shown in the illustrated example embodiment. A 16"×16" opening could use four openings; the size and number of openings is determined by various building codes. Regardless of the size of airflow port(s) 16, it is important to leave a minimum of 1" of foam sheet 12 material between the edge of the airflow port 16 and perimeter surface 20 to allow for compression of foam sheet 12 in structure opening 24 and to provide space on front surface 12*a* for securing mesh sheet 14 with securing members 28. Removable plugs 18 disposed in airflow ports 16 are squeezed when foam sheet 12 is compressed in structure opening 24 to help hold removable plugs 18 in place and form an airtight seal with the rest of foam sheet 12.

To form the airflow ports 16 in foam sheet 12 and removable plugs 18, the foam sheet must be cut without removing material so that removable plugs 18 form a tight fit in airflow ports 16. To do so, foam sheet 12 must first be compressed and then cut so it does not remove product and then removable plugs 18 fit tight. In one embodiment, this is done by making a round cutter without teeth that is plunged into the foam sheet 12 which cuts the airflow port 16 and creates the removable plug 18. Alternatively, the airflow ports can be die cut, wire cut, CNC cut or other suitable methods. Removable plugs 18 are typically used for sealed crawl space environments or used in winter months, in some climates, to reduce airflow and temperature in the crawl space vent opening. Removable plugs 18 can then be removed in the summer to allow greater airflow circulation. The rodent protection insert 10 is also a solution for converting a crawl space from vented to an encapsulated space just by inserting the removable plugs 18 in airflow ports 16. Accordingly, rodent protection insert 10 can be used on all applications, whether sealed, vented and both while also providing a high degree of rodent and insect intrusion protection. Referring to FIG. 5, in the illustrated embodiment, removable plugs 18 includes at least one connecting member 36 securing the removable plug 18 to the flexible polymer foam sheet 12. Connecting member 36 is integral with flexible polymer foam sheet 12 and removable plug 18. The connecting member 36 can be severed to allow removable plugs 18 to be removed from a given airflow port 16. Accordingly, connecting member 36 ensures removable plug 18 is not accidentally removed or falls out. In one embodiment, connecting member 36 comprises the outer skin layer on either the front side 12*a* or back side 12*b* of the flexible polymer foam sheet 12, wherein the rest of the foam sheet is cut to form the airflow ports 16. In the illustrated embodiment, the connecting member 36 comprises a small portion of the outer skin layer on the front side 12*a* interconnecting the removable plug 18 with the flexible foam sheet 12.

An option to meet regional codes for sealed crawl spaces is to have additional R value insulation on rodent protection inserts 10. This is accomplished by attaching an additional insulation backing layer 34 on the rear side 12*b* of flexible polymer foam sheet 12. In one embodiment, insulation backing layer 34 comprises a traditional foam block insulation piece added to the rodent protection insert 10, for example, a 7⅞"×15⅞" insulation block. This block may also have a borate additive to discourage termite activity. In one embodiment, the insulation block is attached using a hot melt adhesive or the like on rear surface 12*b* of foam sheet 12.

This product eliminates the need to cut wire on site and drill and screw to install rodent protection in a structure opening. It saves over 90% of labor time to install open or sealed crawl space vent openings inserts for rodent protection. This rodent protection insert 10 can be used for sealing, venting and new rodent protection or replacing damaged openings in basements and crawl spaces, or any other opening in a structure. This multi-use rodent protection insert 10 compresses and seals against the structure opening walls, can be easily trimmed to fit odd sized opening, and removable plugs 18 are held in place in an airtight arrangement or removed to allow for increased airflow as desired for a given application. Accordingly, the rodent protection insert 10 can be used for sealed and encapsulated space application with rodent protection, or for vented rodent resistant insert applications. In either case, the rodent protection insert 10 of the present invention can be used without replacing existing vent covers or rodent protection inserts such as wire mesh that is already in place. Rather, the rodent protection insert 10 can be inserted behind such prior existing covers or rodent protection in the same structure opening. The rodent protection insert 10 can be adapted to provide several options for protective mesh sheet arrangements, including layering sheets for commercial applications. The rodent protection insert 10 is easily adaptable to various structure opening sizes and can further be easily cut or trimmed on site to custom fit any opening. The protective mesh sheets 14 can also be trimmed or folded over the foam to adjust to a given size opening while still allowing the foam sheet 12 to conform to the wall surface and form an airtight engagement. The rodent protection insert 10 is also dual use as being vented when the removable plugs 18 are removed, such as during summer months to increase airflow, and sealed when removable plugs 18 are placed in airflow ports 16, such as during winter months to seal a vent opening, while also providing rodent protection for all uses.

Referring to FIGS. 11 through 22, in a further advantageous embodiment of the present invention, a rodent protection and flood release insert for a structure opening is shown and described including a mounting bracket, designated generally as 40, surrounding flexible polymer foam sheet 12. In the illustrated embodiment, the flexible polymer foam sheet 12 includes a pair of airflow ports 16. Additionally, a protective mesh sheet 14 is movably carried on a front side 12*a* covering the airflow ports 16. As detailed herein above, the protective mesh sheet 14 is adjustable relative to the front side 12*a* of the flexible polymer foam sheet 12 to facilitate bending and release of the flexible polymer foam sheet 12 from the mounting bracket 40 without detaching from the flexible polymer foam sheet 12. The protective mesh sheet 14 preferably comprises a coated metal wire mesh to resist corrosion.

Figure 20:
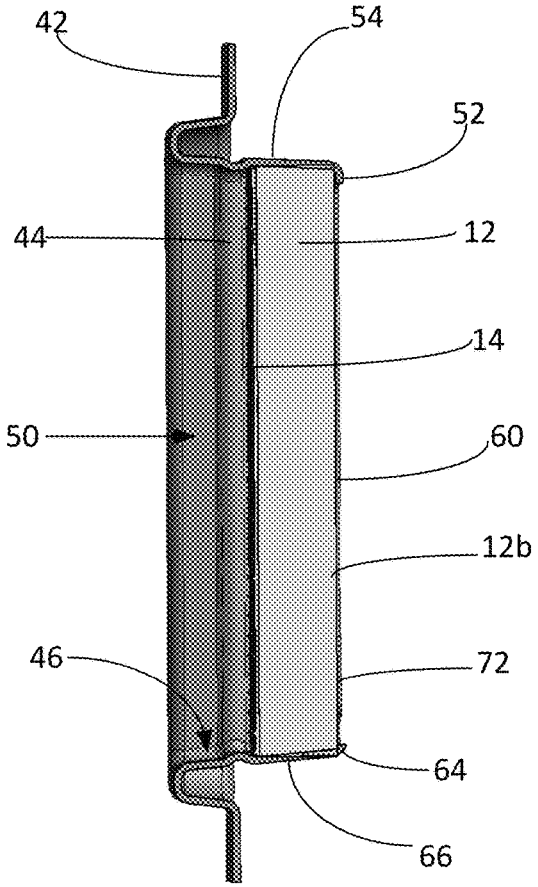
FIG. 20 shows a cross-section view of the mounting bracket, flexible polymer foam sheet and protective mesh sheet along cut-line A-A of FIG. 11.
Figure 21:
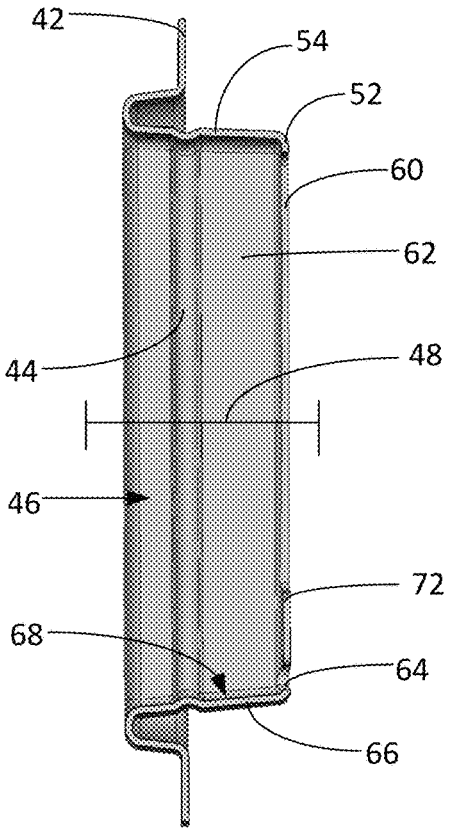
FIG. 21 shows a cross-section view of the mounting bracket along cut-line A-A of FIG. 11; and, FIG. 22 shows a cross-section view of the mounting bracket along cut-line B-B of FIG. 12.
Figure 22:
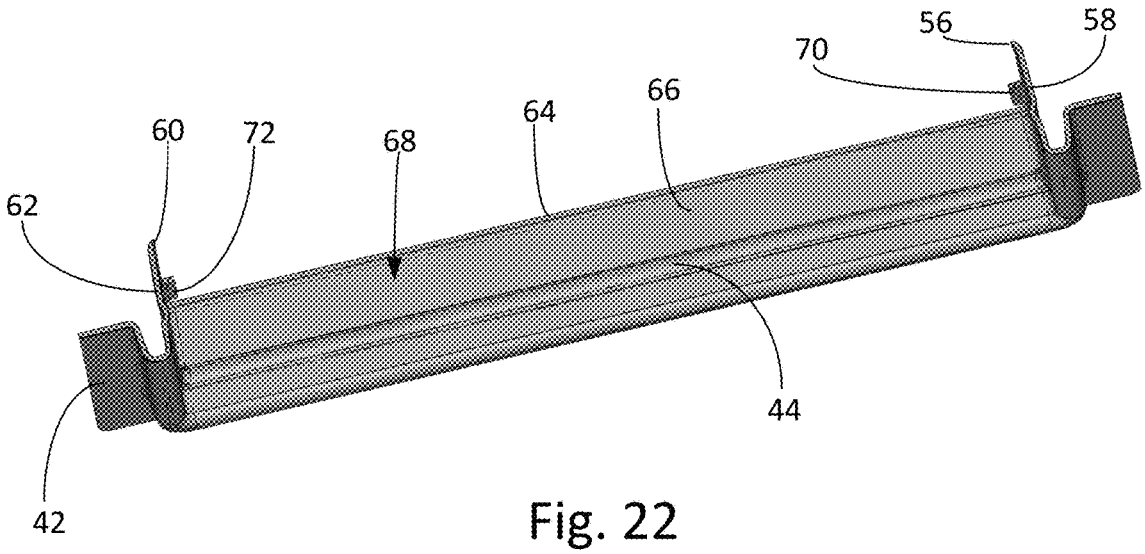

Referring to FIGS. 20-22, in the illustrated embodiment, the mounting bracket 40 includes a mounting flange 42 disposed around an exterior perimeter for engaging a structure surface surrounding a structure opening. The mounting bracket may be secure to the structure surface using an adhesive bonding agent, such as a construction adhesive, caulk, and the like. Preferably, an airtight seal is formed between the mounting bracket and structure surface.

A front retaining ridge 44 is disposed on an interior surface 46 of the mounting bracket engaging at least one of the protective mesh sheet 14 and the front side 12*a* of the flexible polymer foam sheet 12 depending on whether the protective mesh sheet 14 is included. The interior surface 46 of the mounting bracket 40 extends transverse, designed by direction line 48, to the mounting flange 42 and defines an opening, designated generally as 50 (see also FIG. 16), through the mounting bracket 40.

To further help hold the flexible polymer foam sheet 12 in position, an upper retaining flange 52 extending downward from a top portion 54 of the interior surface 46 and engages a rear side 12*b* of the flexible polymer foam sheet 12. A first side retaining flange 56 extends laterally from a first side portion 58 of the interior surface 46 and engages the rear side 12*b* of the flexible polymer foam sheet 12. A second side retaining flange 60 extends laterally from a second side portion 62 of the interior surface 46 opposite the first side portion 58 and engages the rear side 12*b* of the flexible polymer foam sheet 12. A lower retaining flange 64 extends upward from a bottom portion 66 of the interior surface 46 opposite the top portion 54 and engages the rear side 12*b* of the flexible polymer foam sheet 12.

A receiving area, designated generally as 68, is disposed on the interior surface 46 between the front retaining ridge 44 and the upper, lower and side flanges, 52, 56, 60 and 64. The flexible polymer foam sheet 12 compresses against and pushes back against the receiving area 68 in a friction fit arrangement to be releasably carried in the mounting bracket 40. The flexible polymer foam sheet 12 preferably has a high resilience quick response compression and flexibility that presses firmly against the interior surfaces 46 of the mounting bracket 40 or the structure surfaces 22 (FIG. 7) to conform to the adjacent surface while providing a pressure against the surface to help hold the flexible polymer foam sheet 12 in position without mechanical fasteners. The flexible polymer foam sheet 12 is preferably selected from the group consisting of polyethylene, polypropylene, polystyrene, polyvinyl chloride (PVC), poly(methyl methacrylate) (PMMA), epoxy resin, phenolic resin, polyester, polyurethane, and combinations thereof. In a preferred embodiment, the flexible polymer foam sheet 12 comprises a high resilience quick response polyethylene foam. Additionally, the flexible polymer foam sheet 12 may include a closed cell structure on a front surface and a rear surface, and an open cell structure around a perimeter surface. The closed cell structure being provided by a skin or non-porous layer covering the front and rear surfaces of the sheet such that the pores are sealed, while the perimeter edges have exposed cell pores from cutting the edges to expose the interior of the foam and open spaced within and between cells of the foam.

When a predefined amount of water pressure is applied against the flexible polymer foam sheet 12, the water pressure causes the flexible polymer foam sheet 12 to bend and separate completely from the interior surface 46 of the mounting bracket 40 so that the opening 50 through the mounting bracket is unobstructed by the flexible polymer foam sheet 12. The completely unobstructed opening 50 provides for the maximum amount of water flow through the vent opening of the structure. By completely separating and allowing the flexible polymer foam sheet 12 to exit from the mounting bracket, the highest possible water flow rate is achieved and, thus, the maximum industry certification can be applied for water flow rate through the structure opening.

In the illustrated embodiment of FIGS. 11-22, the front retaining ridge 44 extends continuously along the top portion 54, the bottom portion 66, the first side portion 58, and the second side portion 62 of the interior surface 46. Additionally, the upper retaining flange 52 extends across the top portion 54 from the first side retaining flange 56 to the second side retaining flange 60. The first and second side retaining flanges 56, 60 each extend across the first and second side portions 58, 60, respectively, from the upper retaining flange 52 to the lower retaining flange 64. The lower retaining flange 64 extends across the bottom portion 66 from the first side retaining flange 56 to the second side retaining flange 60.

Figure 14:
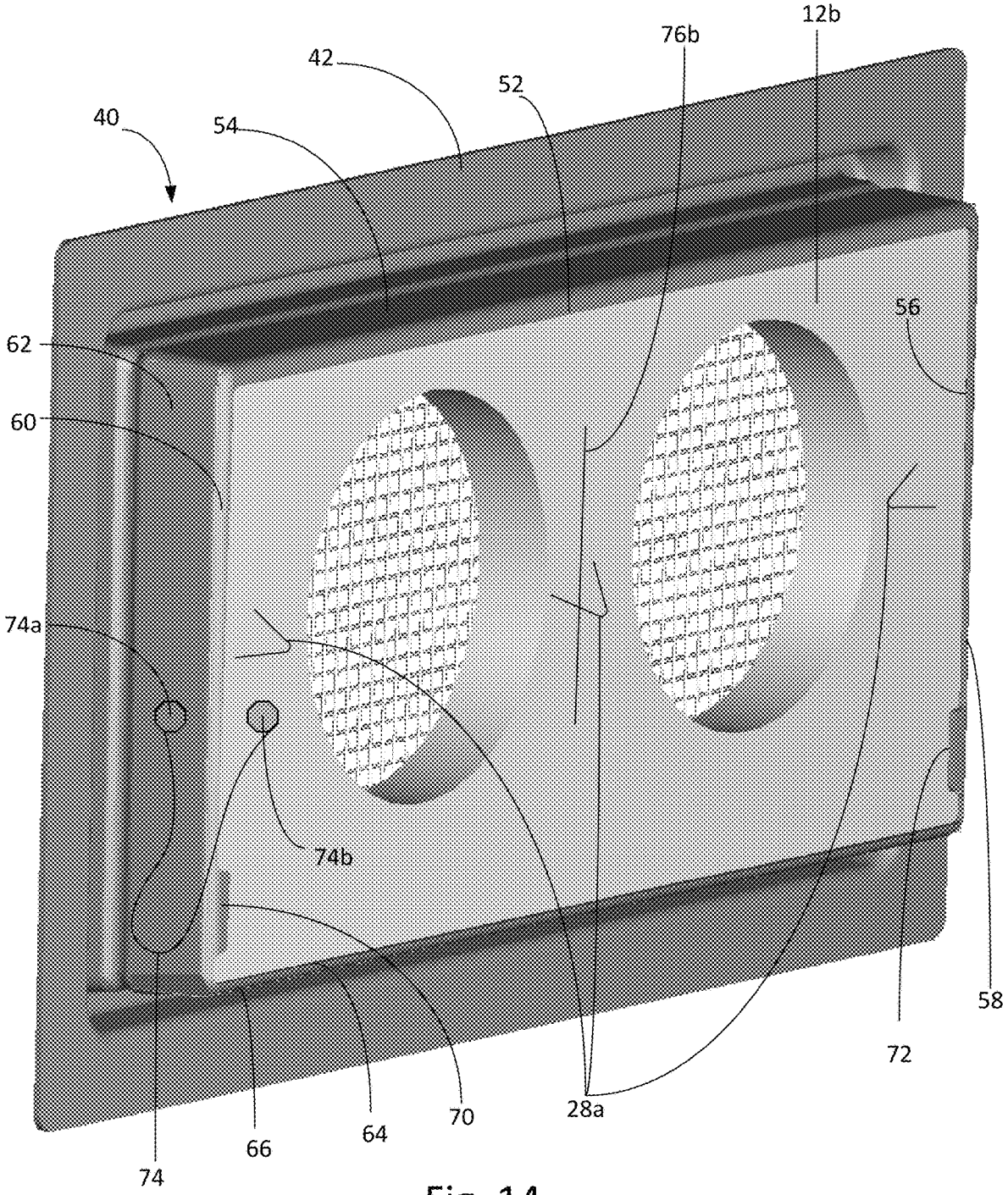
FIG. 14 shows a rear perspective view of the mounting bracket carrying a flexible polymer foam sheet and a protective mesh sheet according to the present invention.
Figure 15:
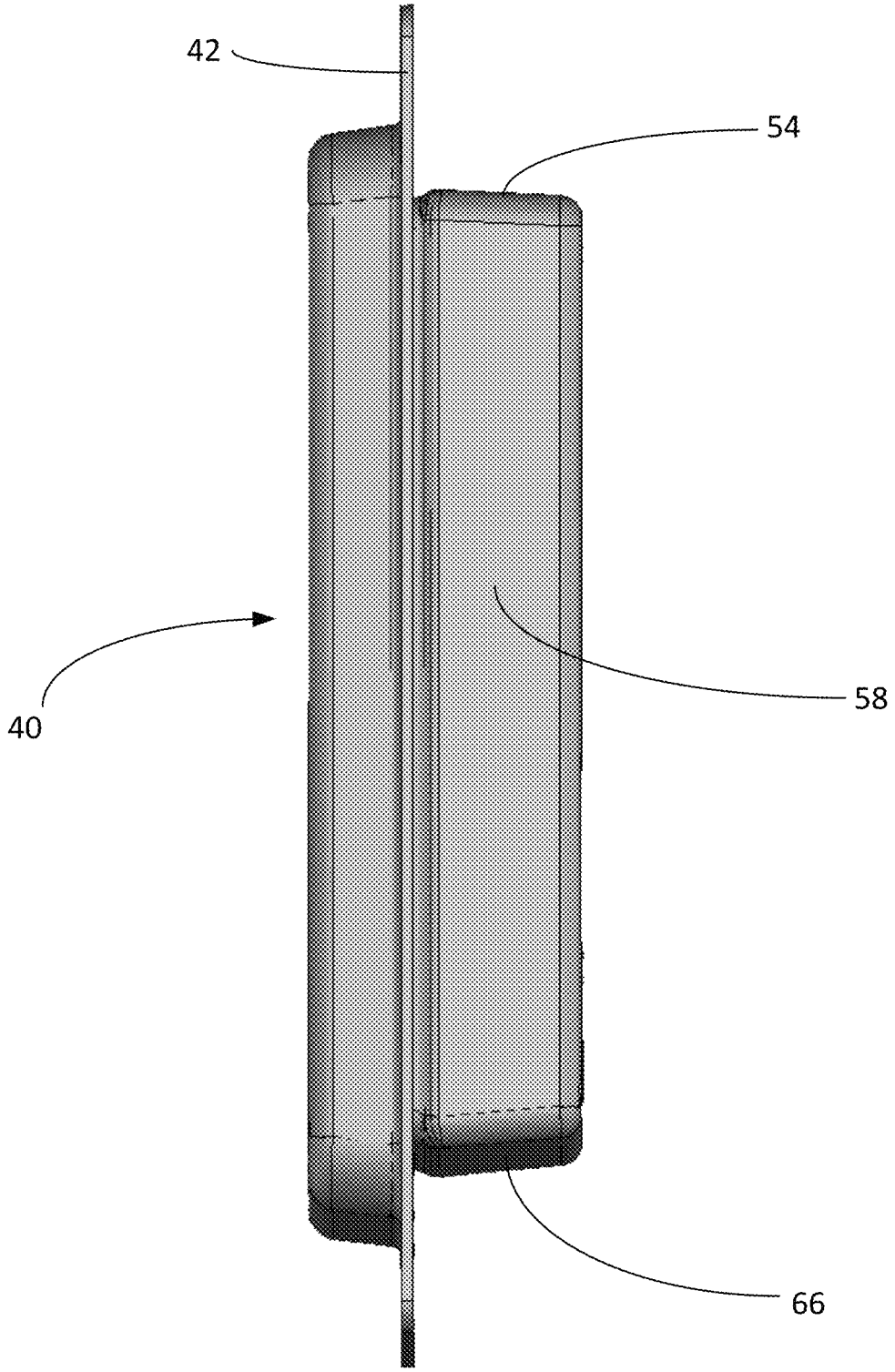
FIG. 15 shows a side view of the mounting bracket according to the present invention.
Figure 16:
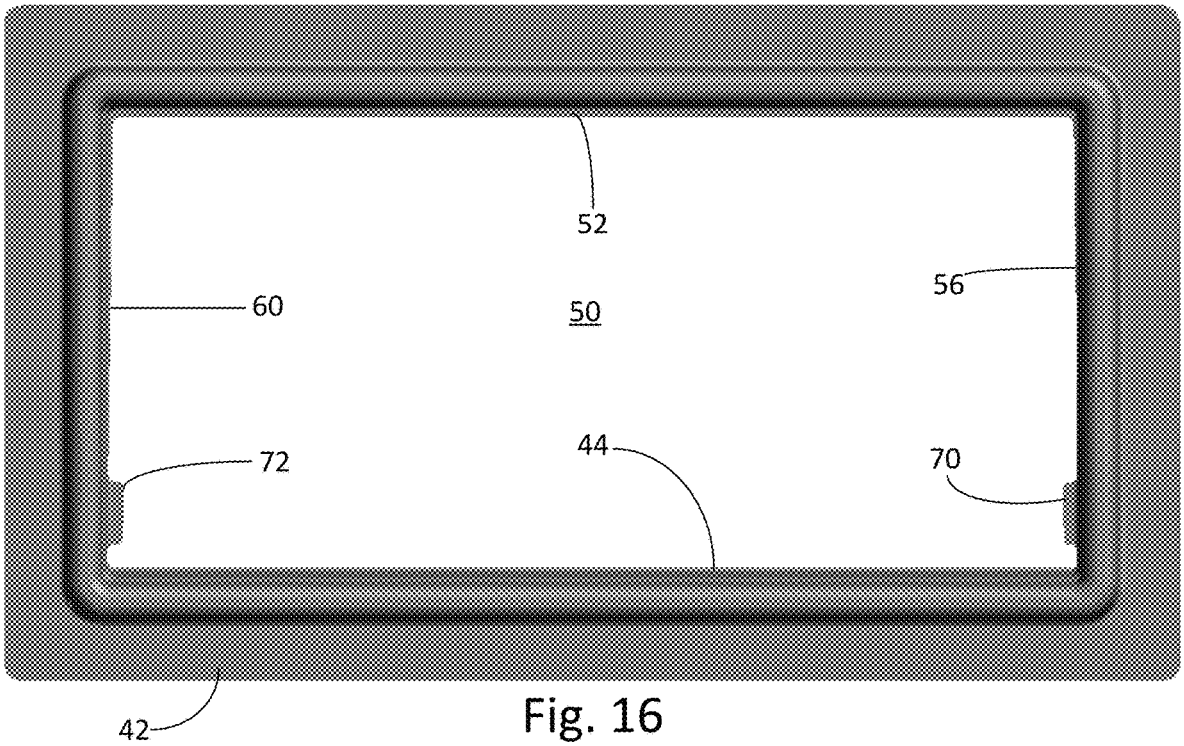
FIG. 16 shows a front view of the mounting bracket according to the present invention.
Figure 17:
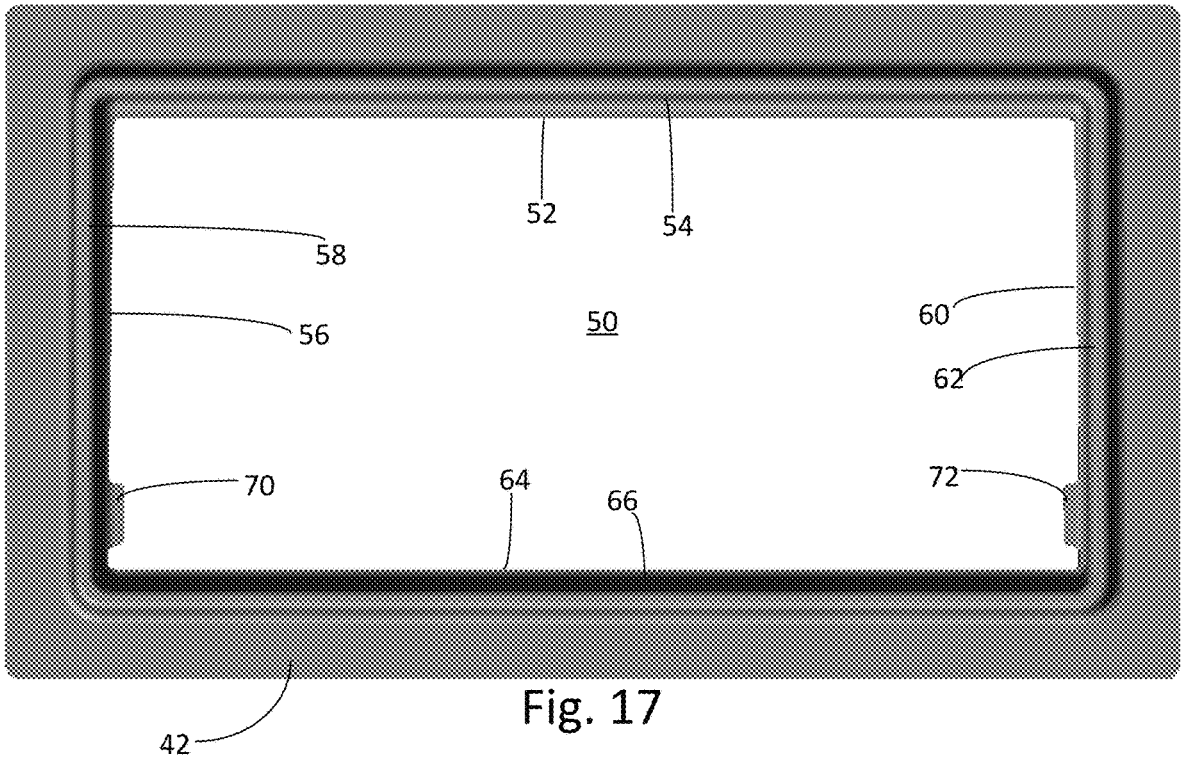
FIG. 17 shows a rear view of the mounting bracket according to the present invention.
Figure 18:
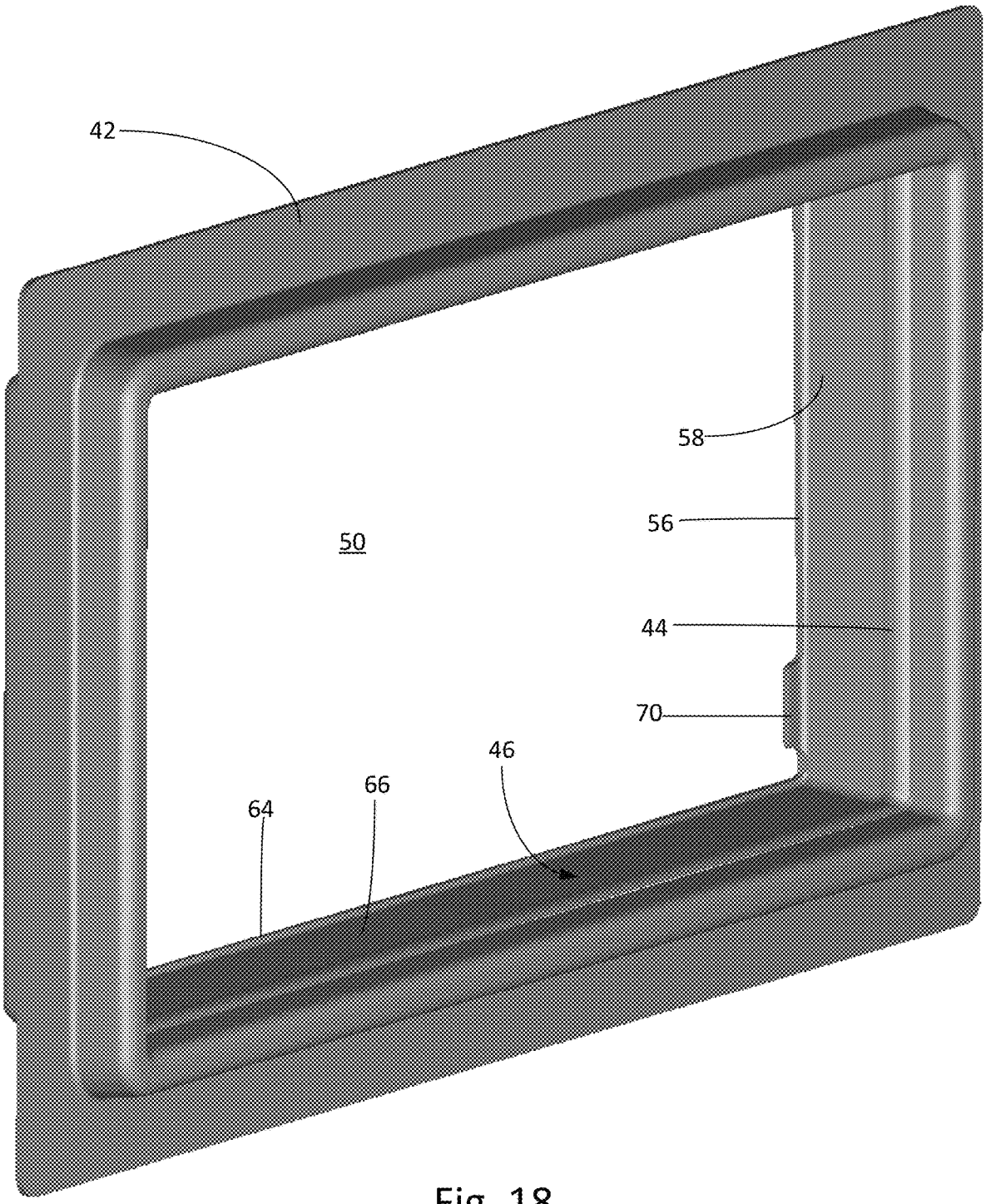
FIG. 18 shows a front perspective view of the mounting bracket according to the present invention.
Figure 19:
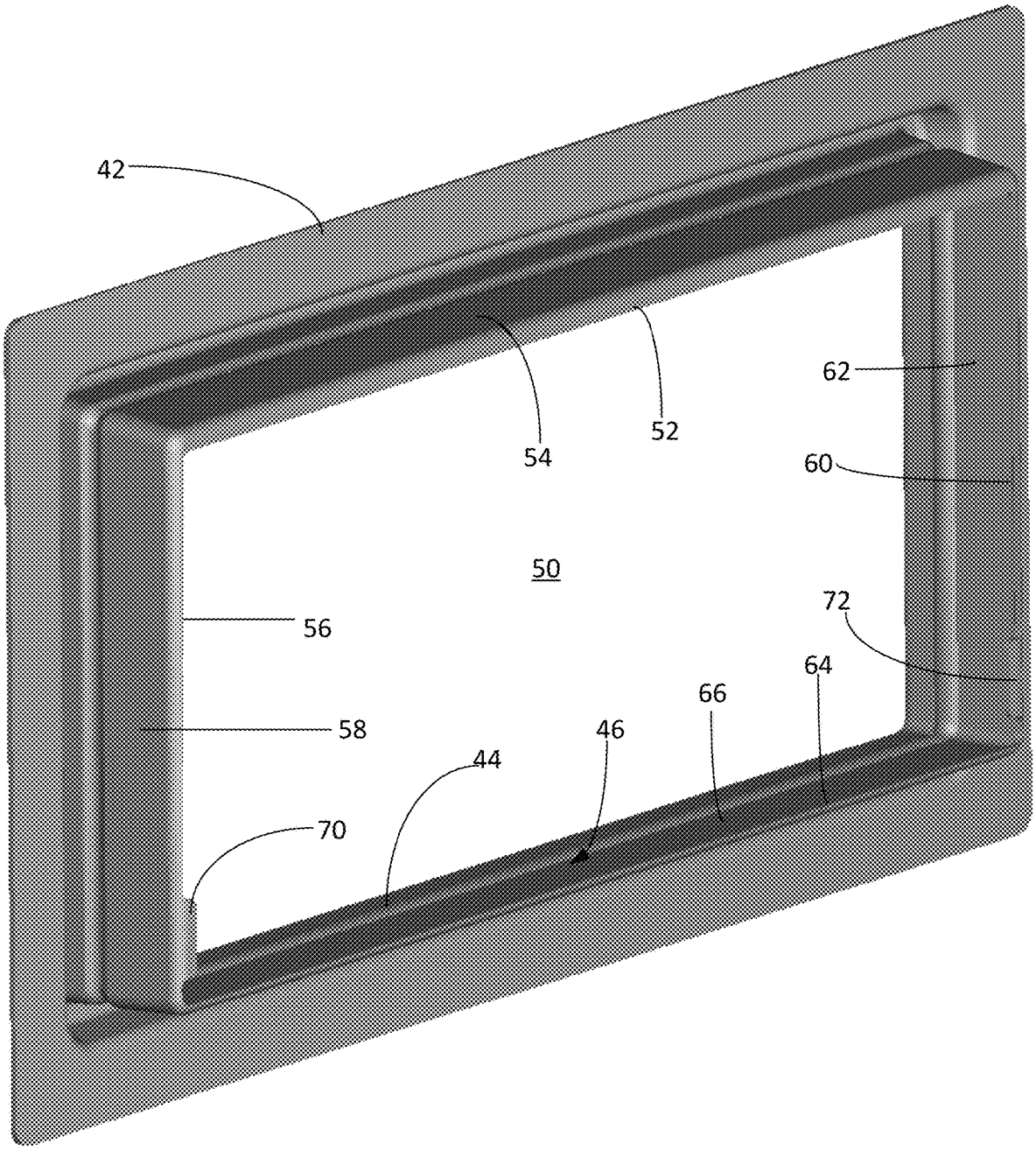
FIG. 19 shows a rear perspective view of the mounting bracket according to the present invention.

Referring to FIG. 14, a first retaining tab 70 extends from the first side retaining flange 56 and engages the rear side 12*b* of the flexible polymer foam sheet 12. Further, a second retaining tab 72 extends from the second side retaining flange 60 and engages the rear side 12*b* of the flexible polymer foam sheet 12 opposite from the first side retaining flange 56. The first and second retaining tabs 70, 72 are disposed generally adjacent the lower retaining flange 64 on opposite sides of the bottom portion 66 of the interior surface 46.

In a preferred embodiment, the first side retaining flange 56, the second side retaining flange 60, and the lower retaining flange 64 extend less than the upper retaining flange 52 and engage less of the flexible polymer foam sheet 12 so that the flexible polymer foam sheet releases from the bottom 66, first side 58, and second side 62 portions of the interior surface 46 before the top portion 54 when the predefined amount of water pressure is applied.

In the illustrated embodiment, the airflow ports 16 are disposed closer to the top portion 54 of the interior surface 46 when carried in the mounting bracket 40. Removable plugs 18 may be disposed in the airflow ports 16 for controlling airflow through the airflow ports as detailed herein above. Removable plugs 18 disposed in airflow ports 16 are squeezed when foam sheet 12 is compressed in mounting bracket 40 to help hold removable plugs 18 in place and form an airtight seal with the rest of foam sheet 12 such that the removable plugs does not release from the airflow ports when water pressure is applied from a flood event. The flexible foam sheet 12 will release from mounting bracket 40 before the removable plugs 18 could be forced out of airflow ports 16.

Referring to FIGS. 14, a tether 74 may be provided having a first distal end portion 74*a* connected to the mounting bracket 40 and a second distal end portion 74*b* connected to the flexible polymer foam sheet 12 so that when the flexible foam sheet 12 is separated from the interior surface 46 of the mounting bracket 40 it remains connected to avoid loss but provides an unobstructed opening 50 through mounting bracket 40.

Figure 12:
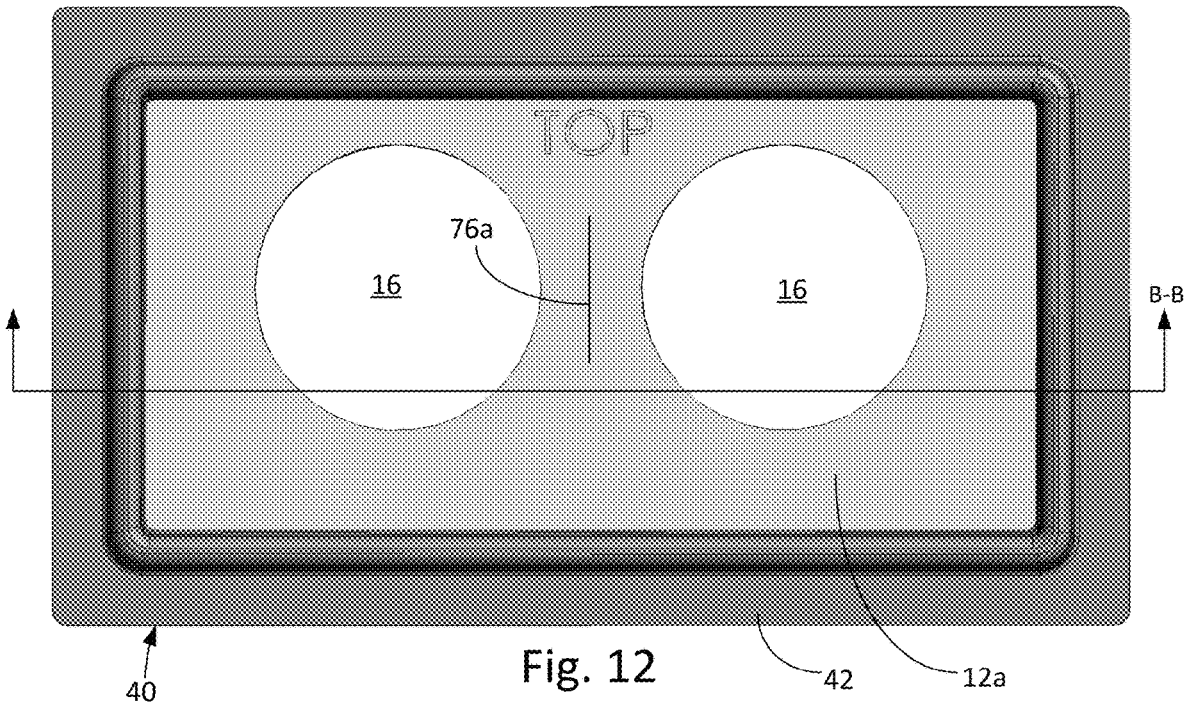
FIG. 12 shows a front view of the mounting bracket carrying a flexible polymer foam sheet according to the present invention.
Figure 13:
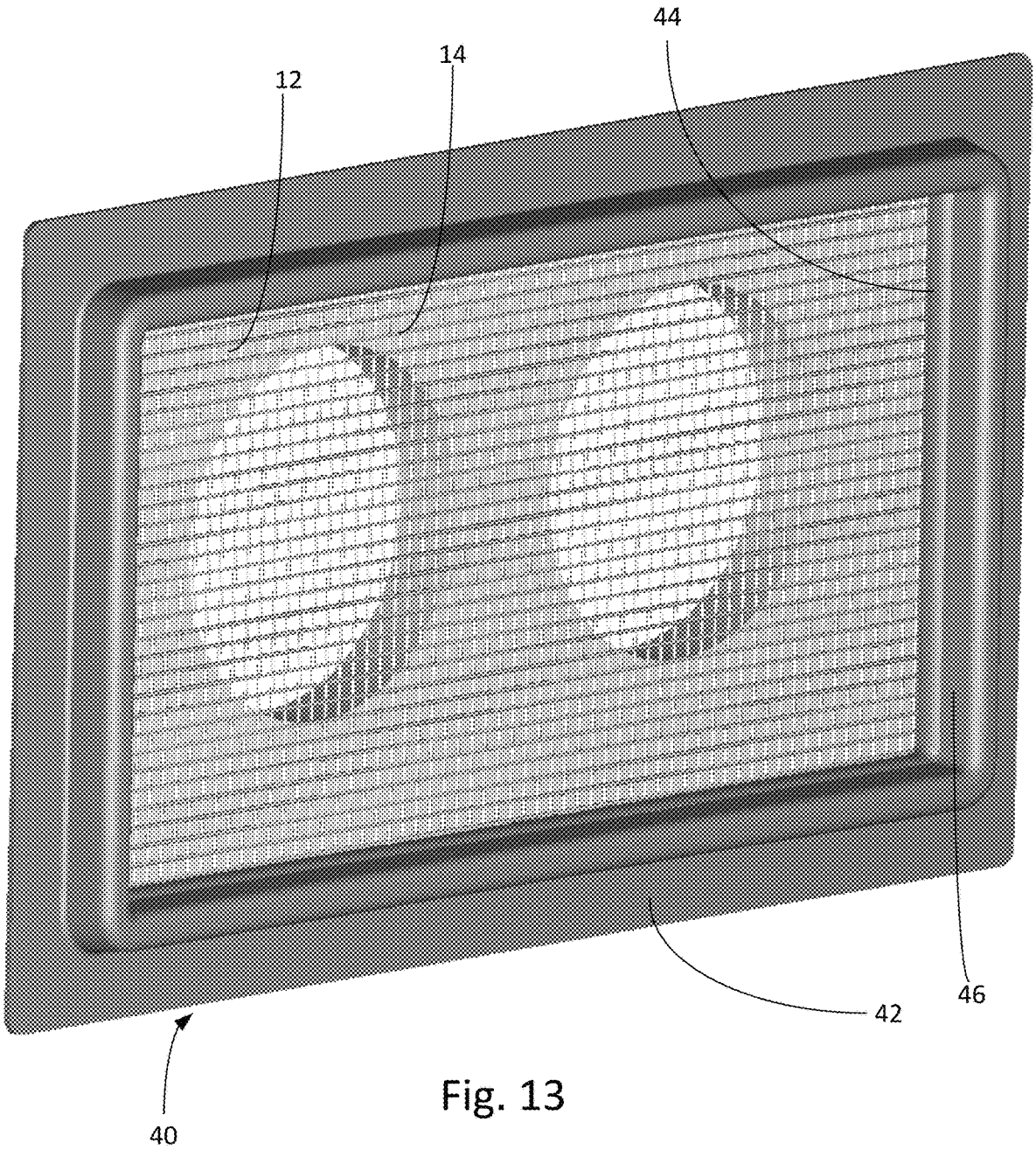
FIG. 13 shows a front perspective view of the mounting bracket carrying a flexible polymer foam sheet and a protective mesh sheet according to the present invention.

Referring to FIGS. 12 and 14, the flexible polymer foam sheet may also include a front score line 76*a* extending into the front side 12*a* of the flexible polymer foam sheet, and a rear score line 76*b* extending into the rear side 12*b* of the flexible polymer foam sheet 12 to facilitate bending for separating from the mounting bracket 40.

Figure 11:
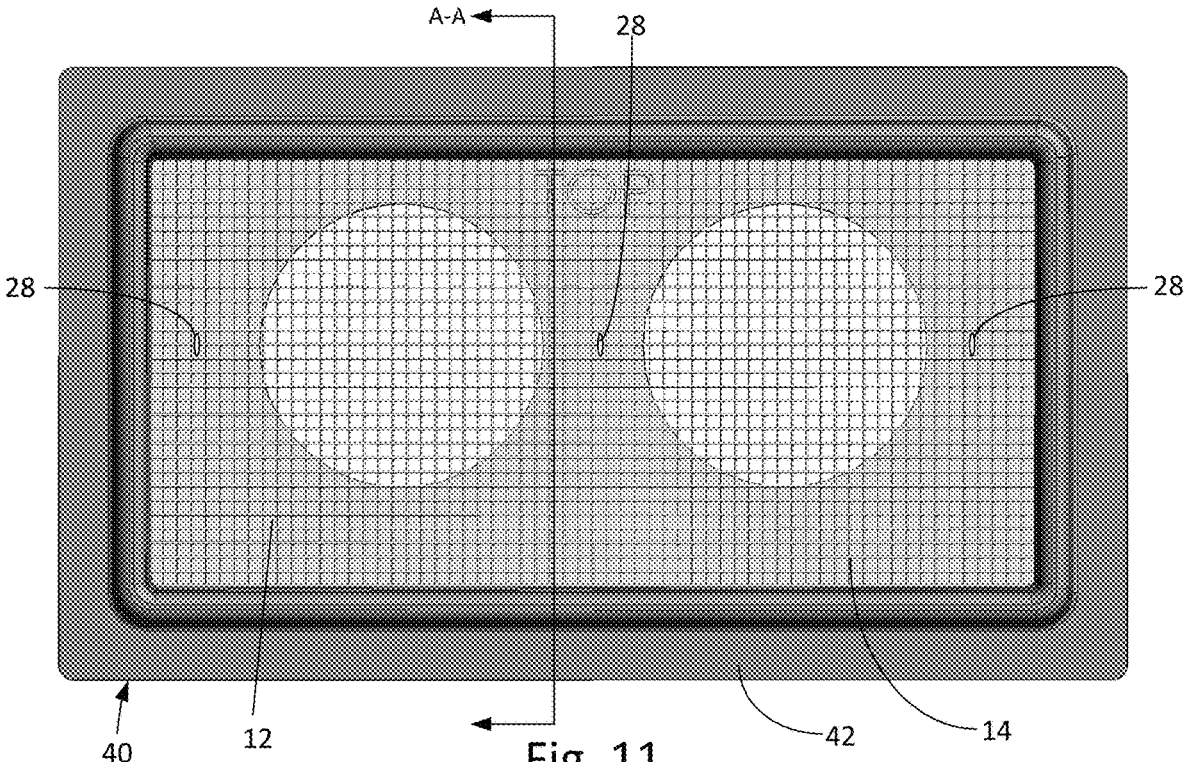
FIG. 11 shows a front view of a mounting bracket carrying a flexible polymer foam sheet and a protective mesh sheet according to the present invention.

Referring to FIGS. 11 and 14, a series of securing members 28 are provided having a first portion anchored in the foam sheet and a second portion engaging the protective mesh sheet as detailed herein above. The second portion loops over at least one wire of the protective mesh sheet such that the protective mesh sheet is movable in both horizontal and vertical directions.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A rodent protection and flood release insert for a structure opening comprising:

a mounting bracket surrounding a flexible polymer foam sheet, wherein said flexible polymer foam sheet includes at least one airflow port, and a protective mesh sheet movably carried on a front side covering at least said airflow port;

a mounting flange disposed around an exterior perimeter of said mounting bracket for engaging a structure surface surrounding a structure opening;

a front retaining ridge disposed on an interior surface of said mounting bracket engaging at least one of said protective mesh sheet and said front side of said flexible polymer foam sheet, wherein said interior surface extends transverse to said mounting flange and defines an opening through said mounting bracket;

an upper retaining flange extending downward from a top portion of said interior surface and engaging a rear side of said flexible polymer foam sheet;

a first side retaining flange extending laterally from a first side portion of said interior surface and engaging said rear side of said flexible polymer foam sheet;

a second side retaining flange extending laterally from a second side portion of said interior surface opposite said first side portion and engaging said rear side of said flexible polymer foam sheet;

a lower retaining flange extending upward from a bottom portion of said interior surface opposite said top portion and engaging said rear side of said flexible polymer foam sheet;

a receiving area disposed on said interior surface between said front retaining ridge and said upper, lower and side flanges, wherein said flexible polymer foam sheet compresses against said receiving area in a friction fit arrangement to be releasably carried in said mounting bracket; and, wherein a predefined amount of water pressure applied against said flexible polymer foam sheet causes said flexible polymer foam sheet to bend and separate completely from said interior surface so that said opening through said mounting bracket is unobstructed, and said at least one protective mesh sheet is adjustable relative to said front side of said flexible polymer foam sheet to facilitate bending and release of said flexible polymer foam sheet from said mounting bracket.

2. The rodent protection and flood release insert of claim 1 wherein said front retaining ridge extends continuously along said top portion, said bottom portion, said first side portion, and said second side portion of said interior surface.

3. The rodent protection and flood release insert of claim 1 including a first retaining tab extending from said first side retaining flange and engaging said rear side of said flexible polymer foam sheet.

4. The rodent protection and flood release insert of claim 3 including a second retaining tab extending from said second side retaining flange and engaging said rear side of said flexible polymer foam sheet.

5. The rodent protection and flood release insert of claim 4 wherein said first and second retaining tabs are disposed generally adjacent said lower retaining flange on opposite sides of said bottom portion of said interior surface.

6. The rodent protection and flood release insert of claim 1 wherein said first side retaining flange, said second side retaining flange, and said lower retaining flange extend less than said upper retaining flange and engage less of said flexible polymer foam sheet so that said flexible polymer foam sheet releases from said bottom, first side and second side portions of said interior surface before said top portion when said water pressure is applied.

7. The rodent protection and flood release insert of claim 1 wherein said at least one airflow port is disposed closer to said top portion of said interior surface when carried in said mounting bracket.

8. The rodent protection and flood release insert of claim 1 including a removable plug disposed in said at least one airflow port for controlling airflow through said airflow port.

9. The rodent protection and flood release insert of claim 1 wherein said protective mesh sheet comprises a coated metal wire mesh.

10. The rodent protection and flood release insert of claim 1 including a tether having a first distal end portion connected to said mounting bracket and a second distal end portion connected to said flexible polymer foam sheet.

11. The rodent protection and flood release insert of claim 1 wherein said flexible polymer foam sheet includes a front score line extending into said front side of said flexible polymer foam sheet, and a rear score line extending into said rear side of said flexible polymer foam sheet to facilitate bending for separating from said mounting bracket.

12. The rodent protection and flood release insert of claim 1 wherein said flexible polymer foam sheet is selected from the group consisting of polyethylene, polypropylene, polystyrene, polyvinyl chloride (PVC), poly(methyl methacrylate) (PMMA), epoxy resin, phenolic resin, polyester, polyurethane, and combinations thereof.

13. The rodent protection and flood release insert of claim 1 wherein said flexible polymer foam sheet comprises a polyethylene foam having a closed cell structure on a front surface and a rear surface, and an open cell structure around a perimeter surface.

14. The rodent protection and flood release insert of claim 1 including at least one securing member having a first portion anchored in said foam sheet and a second portion engaging said protective mesh sheet, wherein said second portion loops over at least one wire of said protective mesh sheet such that said protective mesh sheet is movable in both horizontal and vertical directions.

15. A mounting bracket for a rodent protection and flood release insert, said mounting bracket comprising:

a mounting flange disposed around an exterior perimeter for engaging a structure surface surrounding an opening, a front retaining ridge disposed on an interior surface, wherein said interior surface extends transverse to said mounting flange and defines an opening through said mounting bracket;

an upper retaining flange extending downward from a top portion of said interior surface;

a first side retaining flange extending laterally from a first side portion of said interior surface;

a second side retaining flange extending laterally from a second side portion of said interior surface opposite said first side portion;

a lower retaining flange extending upward from a bottom portion of said interior surface opposite said top portion;

a receiving area defined along said interior surface between said front retaining ridge and said upper, lower, and side flanges for receiving a flexible polymer foam sheet in a friction fit arrangement to be releasably carried in said mounting bracket; and, a first retaining tab extending from said first side retaining flange and engaging a rear side of a flexible polymer foam sheet, and a second retaining tab extending from said second side retaining flange and engaging said rear side of said flexible polymer foam sheet, wherein said first and second retaining tabs are disposed generally adjacent said lower retaining flange on opposite sides of said bottom portion of said interior surface.

16. The mounting bracket of claim 15 wherein said front retaining ridge extends continuously along said top portion, said bottom portion, said first side portion, and said second side portion of said interior surface; and wherein said upper retaining flange extends across said top portion from said first side retaining flange to said second side retaining flange, said first and second side retaining flanges each extend across said first and second side portions, respectively, from said upper retaining flange to said lower retaining flange, and said lower retaining flange extends across said bottom portion from said first side retaining flange to said second side retaining flange.

17. The mounting bracket of claim 15 wherein said first side retaining flange, said second side retaining flange, and said lower retaining flange extend less than said upper retaining flange and engage less of said flexible polymer foam sheet so that said flexible polymer foam sheet releases from said bottom, first side and second side portions of said interior surface before said top portion when said water pressure is applied.

18. A rodent protection and flood release insert for a structure opening comprising:

a mounting bracket surrounding a flexible polymer foam sheet, wherein said flexible polymer foam sheet includes a protective mesh sheet movably carried on a front side;

a mounting flange disposed around an exterior perimeter of said mounting bracket for engaging a structure surface surrounding a structure opening;

a front retaining ridge disposed on an interior surface of said mounting bracket engaging at least one of said protective mesh sheet and said front side of said flexible polymer foam sheet, wherein said interior surface extends transverse to said mounting flange and defines an opening through said mounting bracket;

an upper retaining flange extending downward from a top portion of said interior surface and engaging a rear side of said flexible polymer foam sheet;

a first side retaining flange extending laterally from a first side portion of said interior surface and engaging said rear side of said flexible polymer foam sheet;

a second side retaining flange extending laterally from a second side portion of said interior surface opposite said first side portion and engaging said rear side of said flexible polymer foam sheet;

a lower retaining flange extending upward from a bottom portion of said interior surface opposite said top portion and engaging said rear side of said flexible polymer foam sheet;

wherein said upper retaining flange extends across said top portion from said first side retaining flange to said second side retaining flange, said first and second side retaining flanges each extend across said first and second side portions, respectively, from said upper retaining flange to said lower retaining flange, and said lower retaining flange extends across said bottom portion from said first side retaining flange to said second side retaining flange;

wherein said front retaining ridge extends continuously along said top portion, said bottom portion, said first side portion, and said second side portion of said interior surface;

a receiving area disposed on said interior surface between said front retaining ridge and said upper, lower and side flanges, wherein said flexible polymer foam sheet compresses against said receiving area in a friction fit arrangement to be releasably carried in said mounting bracket;

wherein a predefined amount of water pressure applied against said flexible polymer foam sheet causes said flexible polymer foam sheet to bend and separate completely from said interior surface so that said opening through said mounting bracket is unobstructed, and said at least one protective mesh sheet is adjustable relative to said front side of said flexible polymer foam sheet to facilitate bending and release of said flexible polymer foam sheet from said mounting bracket; and, wherein said first side retaining flange, said second side retaining flange, and said lower retaining flange extend less than said upper retaining flange and engage less of said flexible polymer foam sheet so that said flexible polymer foam sheet releases from said bottom, first side and second side portions of said interior surface before said top portion when said water pressure is applied.

19. The rodent protection and flood release insert of claim 18 including a first retaining tab extending from said first side retaining flange and engaging said rear side of said flexible polymer foam sheet, and a second retaining tab extending from said second side retaining flange and engaging said rear side of said flexible polymer foam sheet, wherein said first and second retaining tabs are disposed generally adjacent said lower retaining flange on opposite sides of said bottom portion of said interior surface.

* * * * *